US006370923B1

(12) United States Patent
Chol

(10) Patent No.: US 6,370,923 B1
(45) Date of Patent: Apr. 16, 2002

(54) METHOD AND APPARATUS FOR REMOVING LINTS IN CIRCULAR KNITTING MACHINE

(75) Inventor: Yoo Chol, 101-1109 Hyundai Green APT., 33-2 Seongsool-ka, Seongdong-ku, Seoul (KR)

(73) Assignees: Mi-Hwa Kim; Yoo Chol, both of Seoul (KR)

( * ) Notice: Subject to any disclaimer, the term of this patent is extended or adjusted under 35 U.S.C. 154(b) by 0 days.

(21) Appl. No.: 09/510,172

(22) Filed: Feb. 22, 2000

(30) Foreign Application Priority Data

Feb. 22, 1999 (KR) ..... 99-5767

(51) Int. Cl.[7] ..... D04B 35/32
(52) U.S. Cl. ..... 66/168
(58) Field of Search ..... 66/168, 8, 13; 15/301

(56) References Cited

U.S. PATENT DOCUMENTS 4,691,536 A * 9/1987 Yorisue et al. ..... 66/168
5,195,337 A * 3/1993 Gutschmit ..... 66/168
5,201,793 A * 4/1993 Izumi et al. ..... 66/168
5,282,372 A * 2/1994 Gutschmit ..... 66/168
5,323,509 A * 6/1994 Igarashi et al. ..... 66/168
5,379,614 A * 1/1995 Igarashi ..... 66/168
5,388,431 A * 2/1995 Izumi ..... 66/168
5,408,851 A * 4/1995 Tsuchiya ..... 66/168
5,469,718 A * 11/1995 Gutschmit ..... 66/168
5,544,504 A * 8/1996 Neher et al. ..... 66/168
5,737,942 A * 4/1998 Gutschmit ..... 66/168
5,956,977 A * 9/1999 Cotler ..... 66/168

* cited by examiner

*Primary Examiner*—Danny Worrell
(74) *Attorney, Agent, or Firm*—Birch, Stewart, Kolasch & Birch, LLP

(57) ABSTRACT

A method and apparatus for removing regular/reverse rotational type lints in circular knitting machine which is made to effectively remove not only lints already fallen and piled on needle portion (array of knitting station) but also even lints being falling immediately before the yarn would be knitted. A circular rotating device with a plurality of air blowing devices at a predetermined intervals is provided, which surrounds a center shaft of circular knitting machine and located interior of a yarn group. A driving device which is fixedly at one side around the center shaft is provided, which continuously and reciprocately rotates the rotating device to only a range of predetermined angle smaller than angle of 360°, wherein an air hose for feeding the compressed air or electric wires for supplying an electric power to a plurality of air blowing devices are not to be twisted by means of blowing the lint on the needle portion by a strong wind generated at a plurality of air blowing device reciprocately moving within predetermined angular range in accordance with a regular/reverse rotating operation of the rotating device.

18 Claims, 21 Drawing Sheets

METHOD AND APPARATUS FOR REMOVING LINTS IN CIRCULAR KNITTING MACHINE

BACKGROUND OF THE INVENTION

The present invention relates to a method and apparatus for removing regular/reverse rotational type lints in circular knitting machine which is made to effectively remove not only lints (lint: a long fiber of cotton produced from yarn, which is produced from friction between mainly yarn and a knitting machine and the like, i. e., general designation of fiber dust) already fallen and piled on needle portion (array of knitting station: major portion for knitting such as yarn path, needle, cylinder, cam holder and needle disc) but also even lints being falling immediately before the yarn would be knitted, in order to previously prevent that innumerably many lints produced at knitting process in a circular knitting machine would be mixed in to a knitting of yarn through the needle portions.

In general, the lints produced during knitting work are piled and lumped on the needle portion together with dust flying and falling in air and other small impure particles whereby become a lint slub. The lint slub can be knitted together with yarns, and a fabric knitted at a state that thus the lint slub is mixed has a problem that which not only becomes inferior goods but also yarn is cut or needle is broken whereby the knitting work is discontinued. Accordingly, an attempt to effectively remove the lint of needle portion is yet a common task of knitting business entities as well.

Essentially, a knitting machine is a machine having a structure in which a cylinder inserted with needles having diameters of various size rotates and simultaneously moves the needles by a cam whereby knits, and the needle portion being a major part knitted along a circumference of cylinder is a part making to high-class of fabric knitted and outputted or controlling inferior goods, and since usually the needle portion is an open state on a mechanical structure, and when always the lint is fallen on the needle portion or piled thereon, the knitted fabric can not but only be an inverior goods, a removing the lint on needle portion can be said as a necessary matter, and for this sake, when exemplifying a technique for removing the lint in conventional circular knitting machine and mentioning a problem on its technique, it will be as follows.

As a conventional technique, a needle blower of circular knitting machine is made by a structure, as shown in FIG. 20 and FIG. 21, in which a compressed air feeding body C is attached to a center of rotating dial support B and then passed through a dial support B and communicated up to needle groove G of dial E immediately under dial needle D and a compressed air feeding hose F is connected to here and fed compressed air is made to feed to the needle groove G of dial E whereby the compressed air is jetted from discharging hole (a gap produced to a groove so provided that the dial needle freely moves to do a reciprocating movement) perforated to the dial needle groove G.

Reviewing a pathway in which the compressed air reaches the needle portion from the structure as above, since the needle groove G of dial E is formed concentrically with circumference of dial E and get dug annularly with wide width, the compressed air fed from the body C can not be jetted on to the needle portion as soon as reaching to the needle groove G of dial E and it is caught to the needle groove G at forward while it is blocked to upper plate H and the dial needle D at upward whereby naturally get dispersed to right and left along the needle groove G and thereby the compressed air fed to the needle groove looses considerable pressure, and since the compressed air of some part decreased with pressure is diffusely dispersed along the gap produced among a number of dial needle D and besides the dial itself is a rotating state, and since the compressed air dispersed through the gap among the dial needle D is sprinkled by a centrifugal force of rotation of dial E and at the same time a jetting direction of the compressed air jetted along the dial needle D also is jetted only to horizontal direction provided with dial needle D, and since it is made by a structure in which the compressed air is not dispersed by cylinder needle K provided vertically by cam holder I and cylinder J, not only a satisfiable compressed air is not reached up to the needle portion but also a directionality capable of covering the needle portion is not given as well, ant therefore there has been a problem that it does not make entirely any help for lint removing but it has only technical formality of lint removing.

As other conventional technique, in accordance with an air blowing device of circular knitting machine as showin in FIG. 22 and FIG. 23, each of multiplicity of compressed air feeding hose L extended from compressed air divider N is connected respectively to a number of air discharging tube M fixedly provided to lint removing part, and it is made by a structure in which the compressed air fed from the compressed air divider N is not fed all at once to multiplicity of compressed air feeding hose L but fed in turn one by one of each compressed air feeding hose L, and further since a number of air discharging tubes M are constructed to discharge the compressed air in a state fixedly provided at always predetermined constant position, it is a situation that the compressed air divider N and the compressed air feeding hoses L connected thereto are not twisted but a lint removing of the needle portion P is not made as it is, and in order to complement this, it is made to a structure vibrating the air discharging tube M, but since this also can not correctly be dispersed toward the lint of needle portion and it is a jetting of sprinkling being got out of needle portion, a problem decreasing an efficiency of lint removing becomes still remained.

In this case, even if it is assumed that it is made to a structure rotating the air discharging tube M in order to make the compressed air to be exactly jetted to the needle portion P in above described conventional technique, a number of compressed air feeding hoses L connected to the compressed air divider N becomes to be twisted to rotating direction, and eventually a problem which can not exert own function becomes still existed as it is.

OBJECT AND SUMMARY OF THE INVENTION

In order to solve such a conventional various problems as above, is an object of the present invention to provide a method and apparatus for removing lints in circular knitting machine in which for the purpose making an air blowing device to be regular/reverse rotation and simultaneously the air feeding hose or electric power supply wire is not twisted so that exact jetting toward needle portion is made, a rotating device in which a plurality of air blowing devices are provided at a predetermined distance on the needle portion is provided in a state of surrounding a center shaft of the circular knitting machine and then, by means of including a driving device for reciprocately rotating the rotating device to regular/reverse direction within same angular range as set interval of plurality of air blowing device, the compressed air feeding hose or electric wire supplying the compressed air or electric power to the rotating device and a plurality of air blowing device provided thereto are made not to be twisted; and a removing efficiency of lint is made to be able to be maximized by removing the lint by a method of blowing a strong wind only toward needle portion without dead angle phenomenon with not to give any disturbance to knitting operation of circular knitting machine; and at the same time the regular/reverse rotation type rotating device provided with plurality of air blowing device is made to be easily provided not only upon manufacturing the circular knitting machine but also to already provided existing circular knitting machine; and further assembling and disassembling are possible in accordance with various pattern and design of knitting fabrics, and handling is easy whereby even a non-expert can easily assemble or disassemble; and structure is simple and economic so that a knitting fabric can be made to a fabric of high classed quality without inferior.

In order to attain above described objects, the present invention comprises:

- a circular rotating device provided with a plurality of air blowing devices at a predetermined intervals, which is a state rotatably surrounding a center shaft of circular knitting machine and located to interior of yarn group;
- a driving device which is fixedly provided at one side around the center shaft, and continuously and reciprocately rotating the rotating device to only a range of predetermined angle smaller than angle of 360°; and
  - which makes an air hose for feeding the compressed air or electric wires for supplying an electric power to a plurality of air blowing device provided to the rotating device not to be twisted, and
  - which removes by means of removing by blowing the lint of needle portion by a strong wind generated at a plurality of air blowing device reciprocately moving within predetermined angular range in accordance with regular/reverse rotating operation of the rotating device.

DETAILED DESCRIPTION OF PREFERRED EMBODIMENTS

Figure 1:
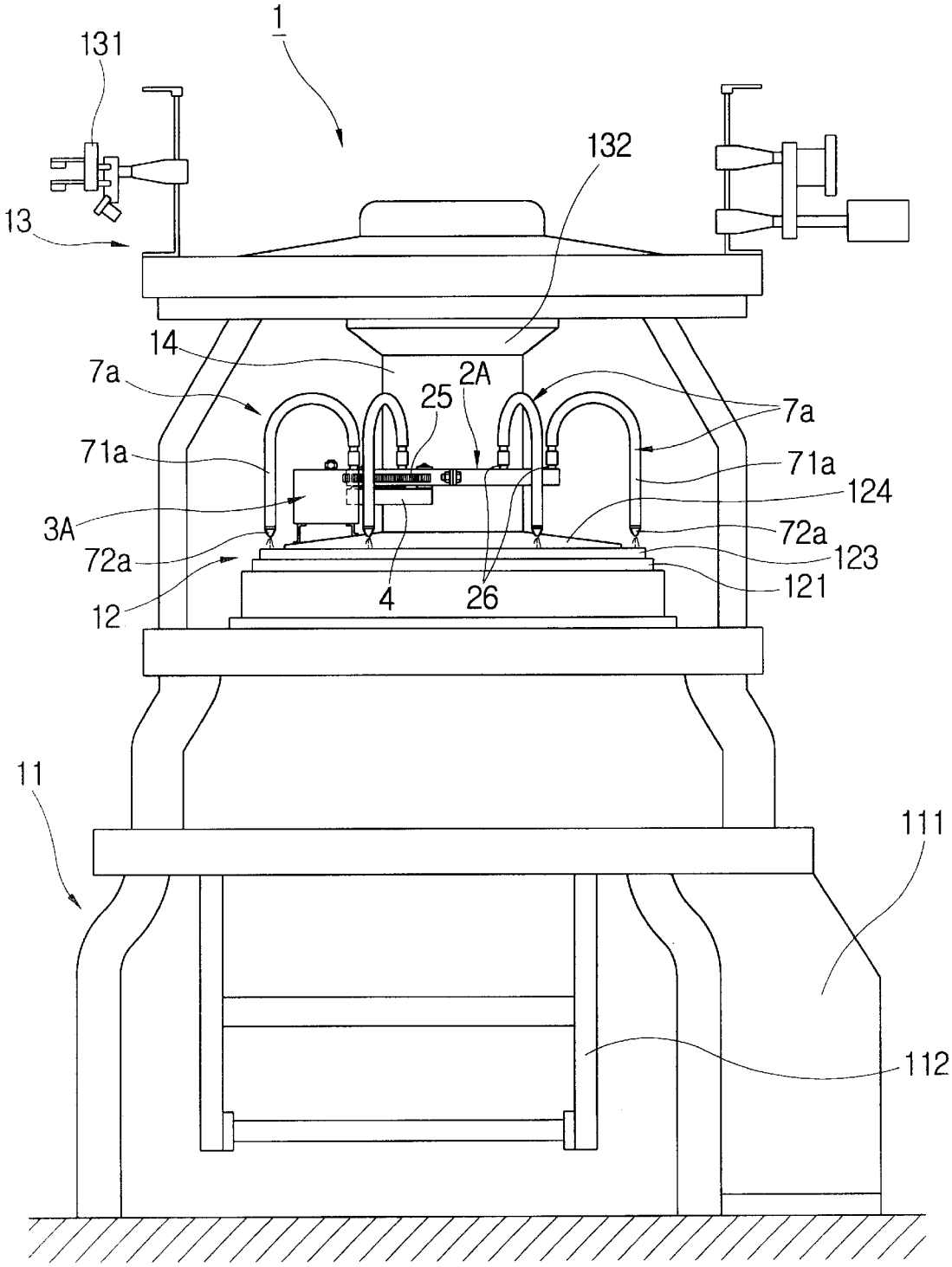
FIG. 1 is an embodiment of the present invention, which is a schematic views showing a provided state of a rotating device applied with air blowing device constructed by air jetting tube for jetting compressed air to big diameter center shaft of circular knitting machine.
Figure 2:
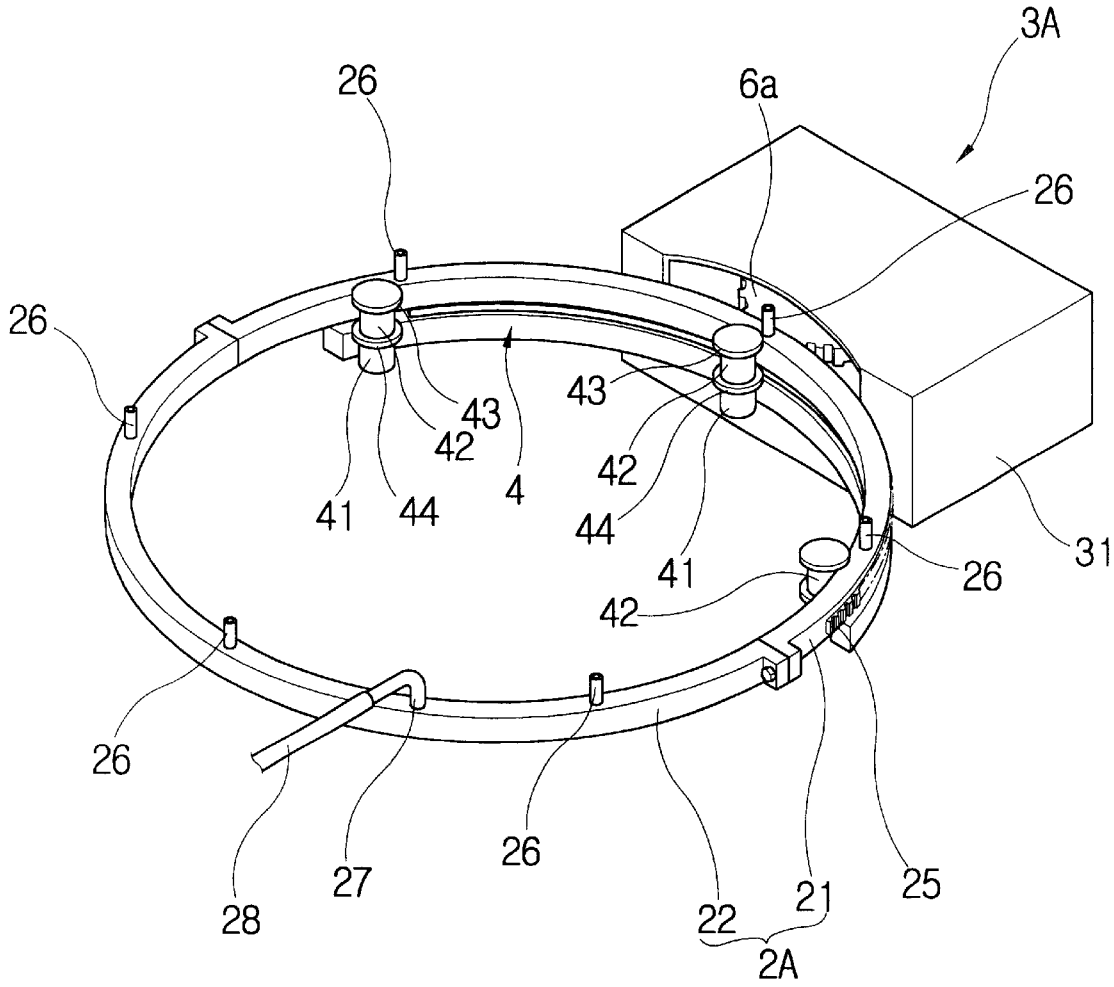
FIG. 2 is a perspective view extracted the rotating device and the driving device of an embodiment of FIG. 1.
Figure 3:
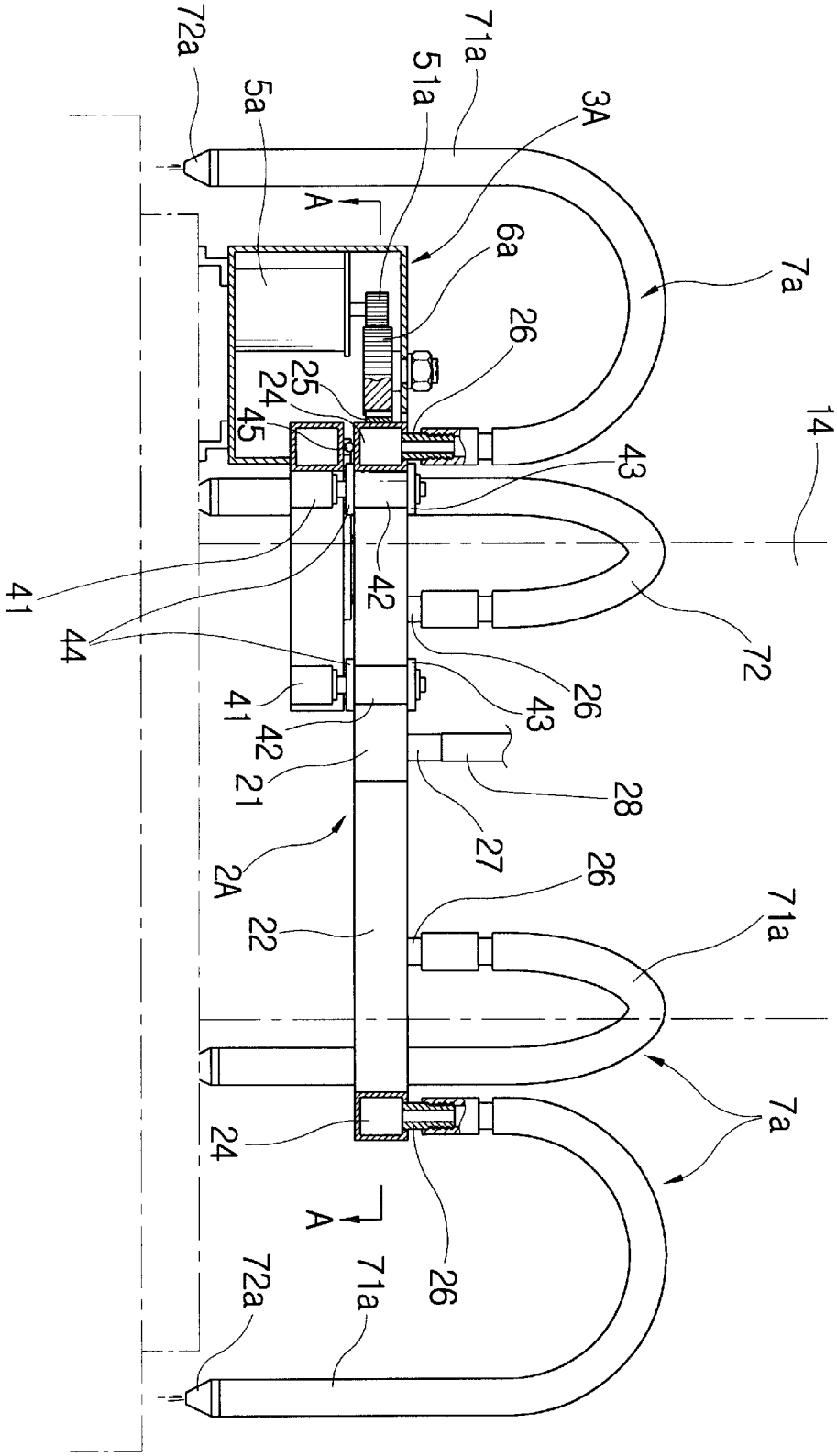
FIG. 3 is a cross sectional view showing a provided state of the rotating device and the driving device of an embodiment of FIG. 1.
Figure 4:
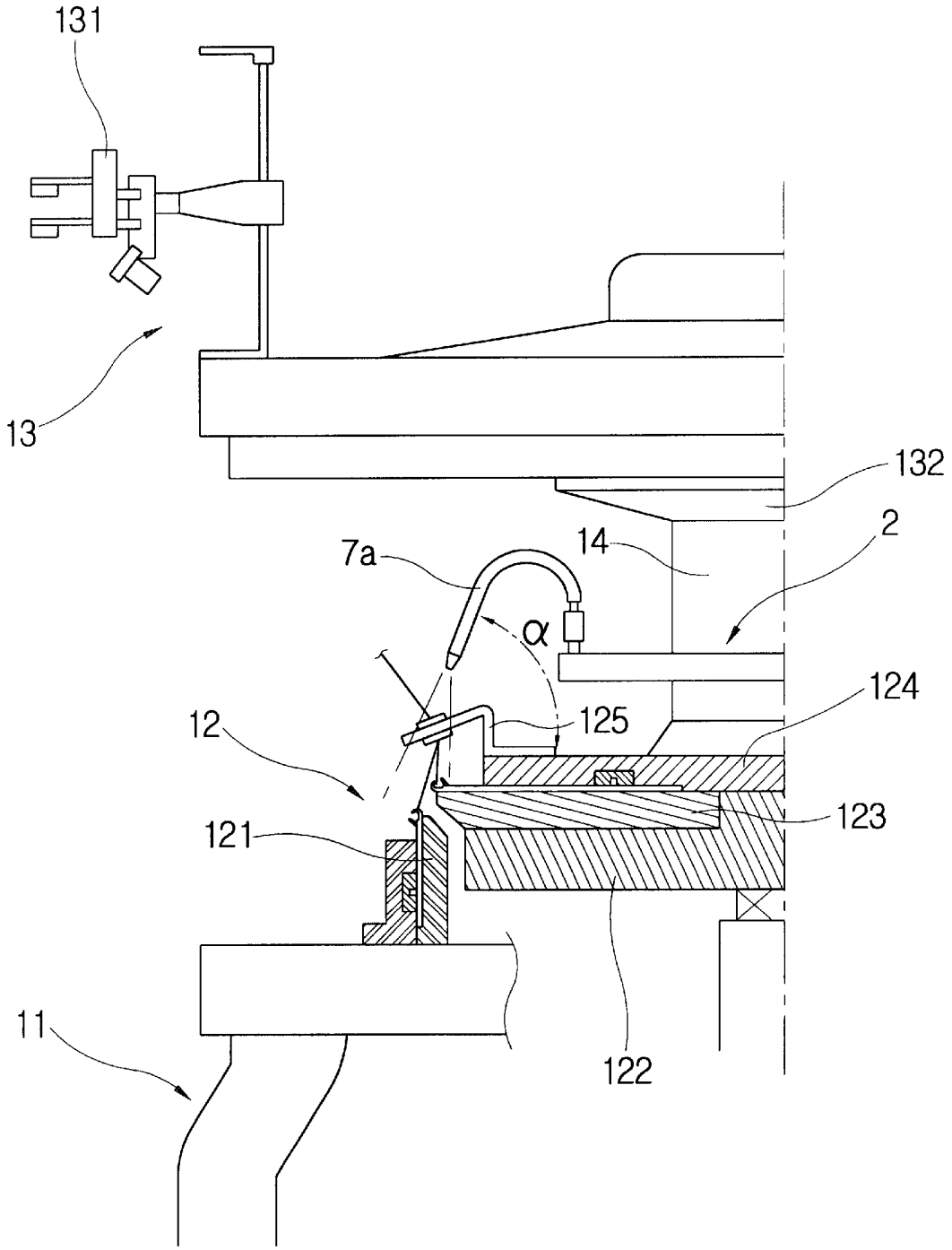
FIG. 4 is a view showing an operating state that the air jetting tube of the rotating device of an embodiment of FIG. 1 jets a compressed air.
Figure 5:
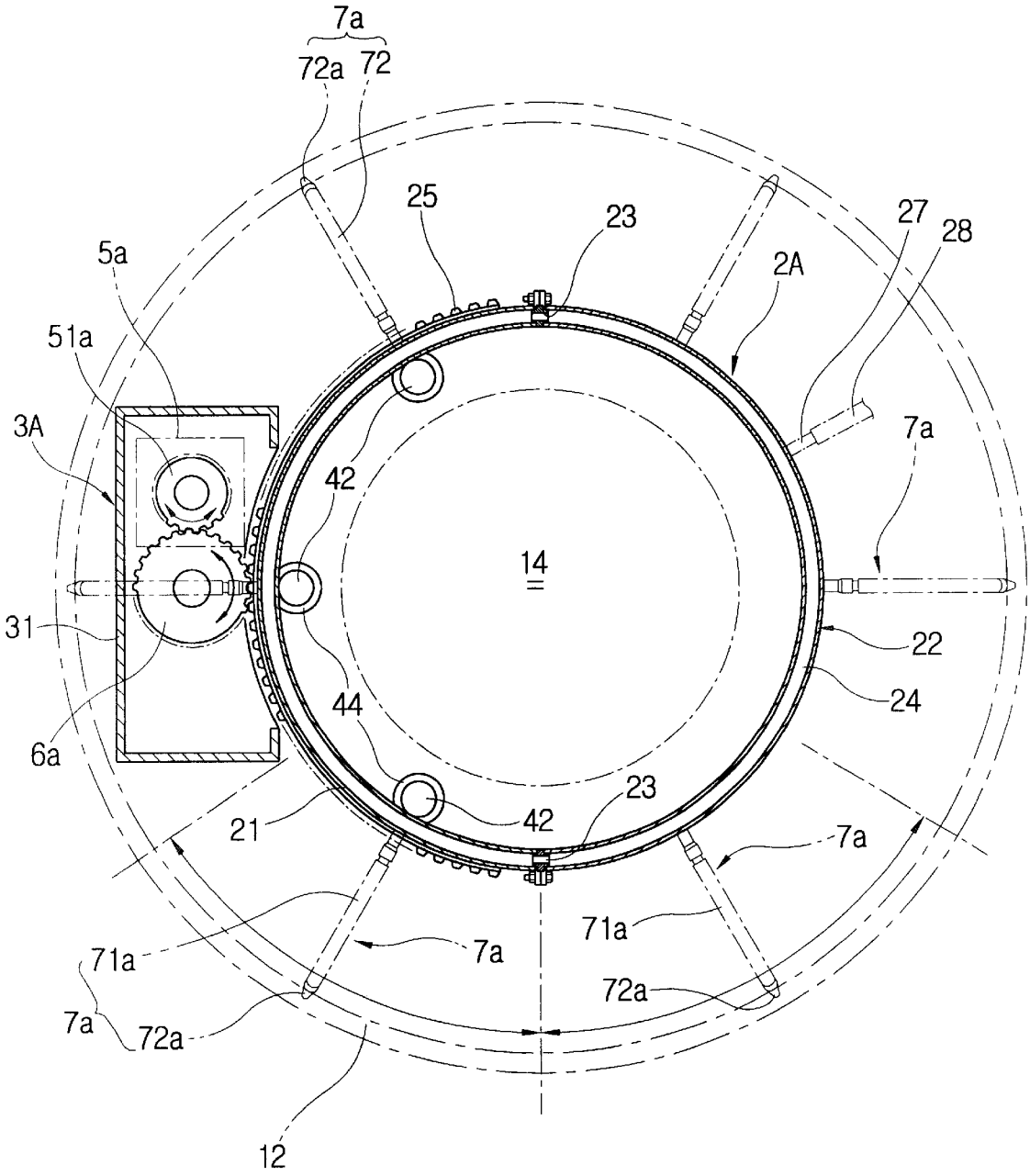
FIG. 5 is a cross sectional view taken along A—A line of FIG. 3, and which is a view exemplifying a reciprocating operation state of the air jetting tube.
Figure 6:
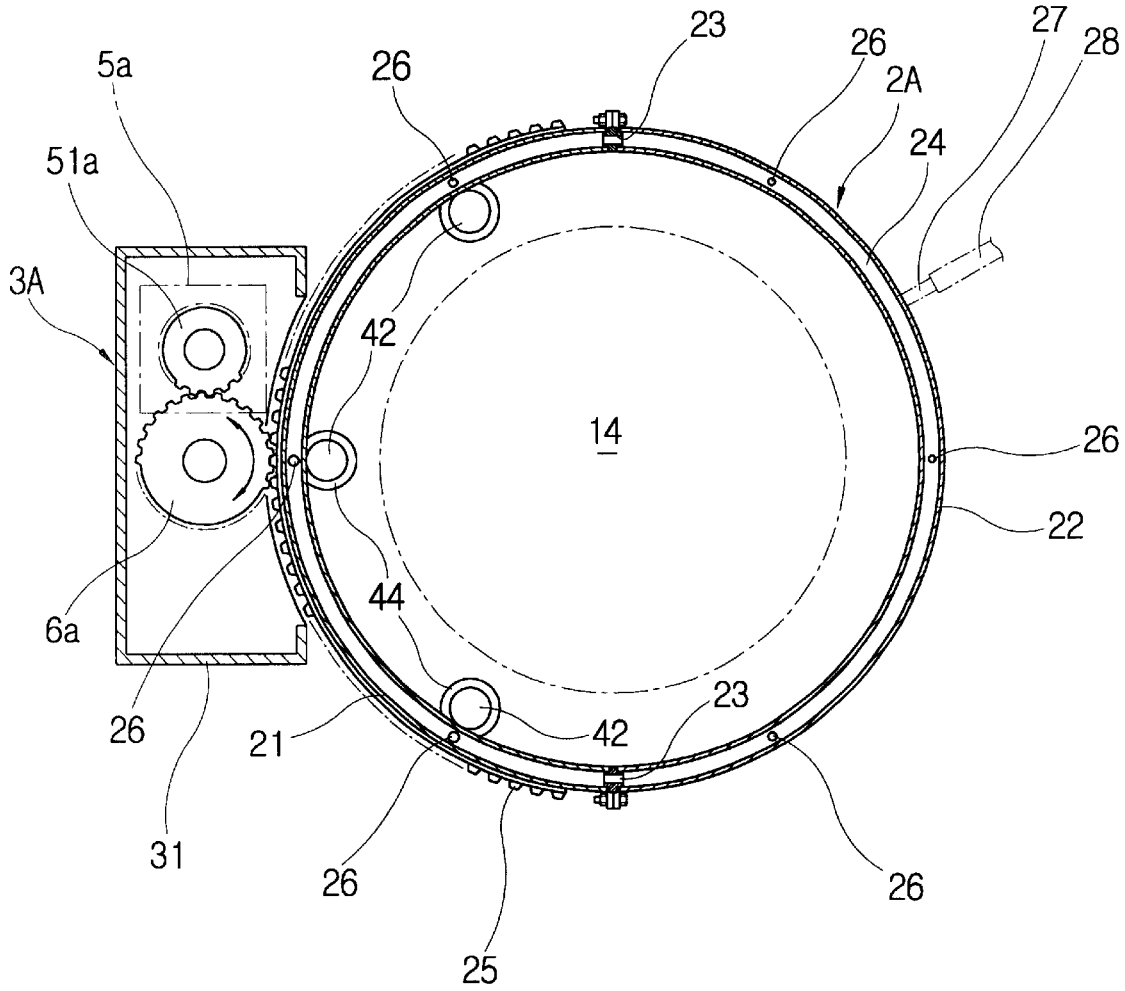
FIG. 6 is a cross sectional view showing a state that inner diameter of the air feeding means for feeding the air to a plurality of air jetting tubes provided to one surface (upper surface) of the rotating device of an embodiment of FIG. 1 to become gradually bigger.

Hereinafter, each embodiment of the present invention will be described more in detail with reference to the accompanying drawings.

FIG. 1 to FIG. 7 are views for showing embodiments applied a rotating device in which a plurality of air blowing devices made of air jetting pipe to center shaft made of big diameter to a center portion of circular knitting machine main body at predetermined intervals as well as a driving device for reciprocately operating the rotating device to regular/reverse directions, FIG. 8 to FIG. 13 are views of embodiments applied a rotating device in which a plurality of air blowing devices made of air blowing fan to a center shaft made of big diameter to a center portion of circular knitting machine main body at predetermined intervals as well as a driving device for reciprocately operating the rotating device to regular/reverse directions, and FIG. 14 to FIG. 19 are views of embodiments applied a rotating device in which a plurality of air blowing devices made of air jetting pipe to center shaft made of small diameter to a center portion of circular knitting machine main body as well as a driving device for reciprocately operating the rotating device to regular/reverse directions.

In the drawings, a reference numeral symbol 1 depicts a circular knitting machine, and the circular knitting machine 1 includes a main body 11 provided with control box 111 and fabric take-up winder 112; a needle portion 12 provided with cylinder 121, dial supporter 122, dial 123, upper plate (needle disk) 124 and yam guide 125; and a yam feeding portion 13 provided with a number of yarn feed devices 131, and a center shaft 14 made of big diameter or small diameter is provided to a center portion of the main body 11 and the needle portion 12, and upper main base cover 132 at top end of the center shaft 14 is provided at a state supporting the yarn feeding portion 13.

Firstly, as shown in FIG. 1 to FIG. 6, it will be described for an embodiment provided with a rotating device 2A of rotating means and a driving device 3A of driving means required by the present invention to the circular knitting machine 1 in which a center shaft 14 provided to center portion of the main body 11 and needle portion 12 is made to a big diameter.

Since the rotating device 2A of rotating means of said embodiment has to have a size capable of surrounding the center shaft 14 of big diameter, it should be manufactured to a bigger size than the center shaft 14 of big diameter, and since it should driven even by a small power, the rotating device 2A is desirable to be manufactured so as to minimize its own weight. Accordingly, the rotating device 2A provided to the center shaft 14 of big diameter should be manufactured by an arc shaped ring which is small in top/bottom width and hollow or by cylindrical tube of double tube structure, and the rotating device 2A itself is desirable to make a divided structure to be at least more than two so as to be able to provide around the center shaft 14 of already provided big diameter.

In above described embodiment, the rotating device 2A assembled by an arc shaped ring of more than two is formed with flange at both ends of the arc shaped ring 21, 22 being divided into two whereby made to be able to assemble by bolt etc., and an interior of the arc shaped ring 21, 22 is defined by empty space, and a sealing material 23 such as packing or gasket is provided to both ends interiors being coupled by bolts whereby the empty space of two arc shaped rings 21, 22 are communicated each other so that a circular connecting path 24 is made to whole of interior of the rotating device 2A at a time when the arc shaped rings 21, 22 are coupled to circular shape.

The rotating device 2A is so provided that a rotating operation is possible as it surrounds the center shaft 14 of big diameter, and as a construction for this, a driving device 3A of driving means fixedly provided to circular disc which is formed integral with the center shaft 14 or attached by welding or bolt whereby making horizon with needle portion 12 as well as a fixed guide rail 4 fixedly attached to a case 31 of the driving device 3A are utilized so that the rotating device 2A is rotatably supported.

The fixed guide rail 4 is formed to an arc shape having a form as an arc shaped ring 21, 22 constructing the circularly assembled rotating device 2A, and its middle portion is welded at a state being entered the interior of the case 31 of driving device 3A, and a several fixing means 41 are welded at predetermined intervals to interior surface of the fixed guide rail 4.

A upwardly protruded guide roller 42 is rotatably provided to each of the several fixing means 41, and the guide rollers 42 are made to guide the rotating operation of the rotating device 2A as it is closely contacted to interior surface of the rotating device 2A, and a part of the rotating device 2A also provided at a state being entered the interior of the driving device 3A.

And, an arc shaped rack gear 25 receiving a power from motor 5*a* is attached to exterior surface of one side arc shaped ring 21 of the rotating device 2A partly entering the interior of the driving device 3A.

The motor 5*a* mounted to the driving device of the driving means is made of regular/reverse rotational motor driven to regular/reverse directions, and a driving gear 6*a* engaged with output gear 51*a* of the motor 5*a* is a structure engaged to the rack gear 25, and the driving gear 6*a* also rotates to regular/reverse directions in accordance with the motoe 5*a* being driven to regular/reverse directions and simultaneously it is made to rotationally operate the rotating device 2A to regular/reverse directions.

Thus, the driving gear 6*a* is engaged with output gear 51*a* of the motor 5*a* driving to regular/reverse directions whereby rotates the rack gear 25 to regular/reverse directions, and since the rack gear 25 is formed only to one side arc shaped ring 21 of the rotating device 2A, a region of rotating angle in which the driving gear 6*a* rotationally operates the rack gear 25 to regular or reverse direction is made only within range which does not get out of the rack gear 25, on the other hand, a rotational number to regular/reverse directions of the driving gear 6*a* is made to be able to set in accordance with controlling the regular/reverse rotational number of the motor 5*a*. According to this, an angular range in which the rotating device 2A attached with the rack gear 25 reciprocately rotates to regular/reverse directions does not get out of setangle of the rack gear 25 and simultaneously it is made so as to be able to control voluntarily within set angle range (30° to 180°) of each of plurality of air blowing device 7*a* which is provided to the rotating device 2A at predetermined intervals, and a plurality of air blowing device 7*a* being the air blowing means receives a compressed air from exterior whereby jets to the needle portion.

That is, each air blowing devices 7*a* in said embodiment are made by a plurality of air jetting pipes 71*a* made of flexible tube material such as metal made or synthetic resin made creased tube, and each of a plurality of air jetting pipes 71*a* is formed on the rotating device 2A at predetermined intervals and connected to each of air feeding means 26 communicating with connecting pathway 24, and a jetting nozzle 72*a* is attached to each end of the air jetting pipe 71*a*. Each of the air jetting pipes 71*a* is easy to bend, and once it is bent and air jetting angle, direction and setting position are controled, its setting position state is maintained as it is and reciprocately moved whereby compressed air can be jetted.

And, the angular range in response to the rotating device 2A in said embodiment being reciprocately rotated to regular/reverse directions is made to be reciprocately moved at wider angular width than the angle which is set with a plurality of air blowing device 7*a* provided on the rotating device 2A, and as a desirable embodiment, as shown in the drawings, in case when a set angle of plurality of air blowing device 7*a* is made to 60° angle and six are provided, only when the regular/reverse rotational angle of the rotating device 2A should be made to be reciprocately moved to regular/reverse directions within range of at least 60° angle, a plurality of air blowing devices 7*a* can evenly jet the compressed air to whole of needle portion 12, but more preferably, when the reciprocately moving angular range of the rotating device 2A is controled to be reciprocately rotated to be wider about 1° to 5° than 60°, each of plurality of air blowing device 7*a* becomes to jet the air by doubling to both ends portions of region jetting the air, so that a removing effect of lint to be piled at whole of needle portion 12 can be increased.

On the other hand, thus interior/exterior surfaces of the rotating device 2A receiving the regular/reverse rotating power from the driving gear 6*a* engaged to the output gear 51*a* of the motor 5*a* are a state being suppoeted to several guide rollers 42 rotatably attached to the fixing means 41 of the fixing guide rail 4 as well as to the driving gear 6a engaged to the rack gear 25, and since it is a state that a leaving of top/bottom surfaces of the rotating device 2A is prevented by top/bottom ends flanges 43, 44 of the guide rollers 42, the rotating device 2A repeats the reciprocating movement to regular/reverse directions in response to regular/reverse rotating operation of the driving gear 6*a* as maintaining horizon in a state being stabled on the fixing guide rail 4.

The rotating device 2A in aforesaid embodiment, its inner circumferential surface is supported by three guide rollers 42, and on the other hand, since its outer circumferential surface depends on one driving gear 6*a* engaged to the rack gear 25, in order that the rotating device 2A is supported at more stabled state and at the same time it can be smoothly execute the rotating operation, it is also possible to provide another separate idle gear(not shown in the drawings) for stably supporting a rack gear 25 at both sides of the driving gear 6*a*, and in this case, a reciprocately rotating angular range of the rotating device 2A should be so established that the rack gear 25 executes the reciprocating movement within range not to leave the idle gear of not shown both sides.

And, for a set angle of each of the air jetting pipes 71*a* structuring each air blowing device 7*a* being the air blowing means, to set at 30°–90° angle($\alpha$) in vertical direction on basic surface dial 123 making a horizontal surface, the lint falling on the needle portion and the lint piled on the needle portion can be effectively removed.

And, an air injecting means 27 for supplying the compressed air to the connecting pathway 24 is formed, and an air hose 28 extended from a compressor (compressed air generating and supplying device) which is not shown is connected to the air injecting means 27.

In the air pressure supplied to the connecting pathway 24 through the air injecting means 27, an air pressure discharged through the air supplying means 26 neighboring to the air injecting means 27 and an air pressure discharged through the air supplying means 26 left far away from the air injecting means 27 can be differently appeared each other, and in order to solve this, in this invention, in order that all of air jetting pipes 71*a* of each of a plurality of air blowing device 7*a* connected and provided to the rotating device 2A at predetermined intervals can jet the compressed air by an air pressure sufficient to remove the lint, the air jetting pressure of each air jetting pipes 71*a* is made to be evenly executed by means of forming inner diameter of each air supplying means 26 to be narrower or wider. That is, by means of that the inner diameter of the air supplying means 26 neighboring with the air injecting means 27 is formed to be narrower while the more the air supplying means 26 left far away from the air injecting means 27 is made to be gradually bigger in its inner diameter, the air pressure discharged to the air jetting pipes 71*a* neighboring with air supplying means 27 and the air pressure discharged to the air supplying means 26 left far away from the air injecting means 27 are made to be identical, and thereby the air pressure discharged through the plurality of each air jetting pipe 71*a* is made to be jetted by an air pressure sufficient to remove the lint, so that a removing operation of dust can be evenly made through all of needle portion.

Figure 9:
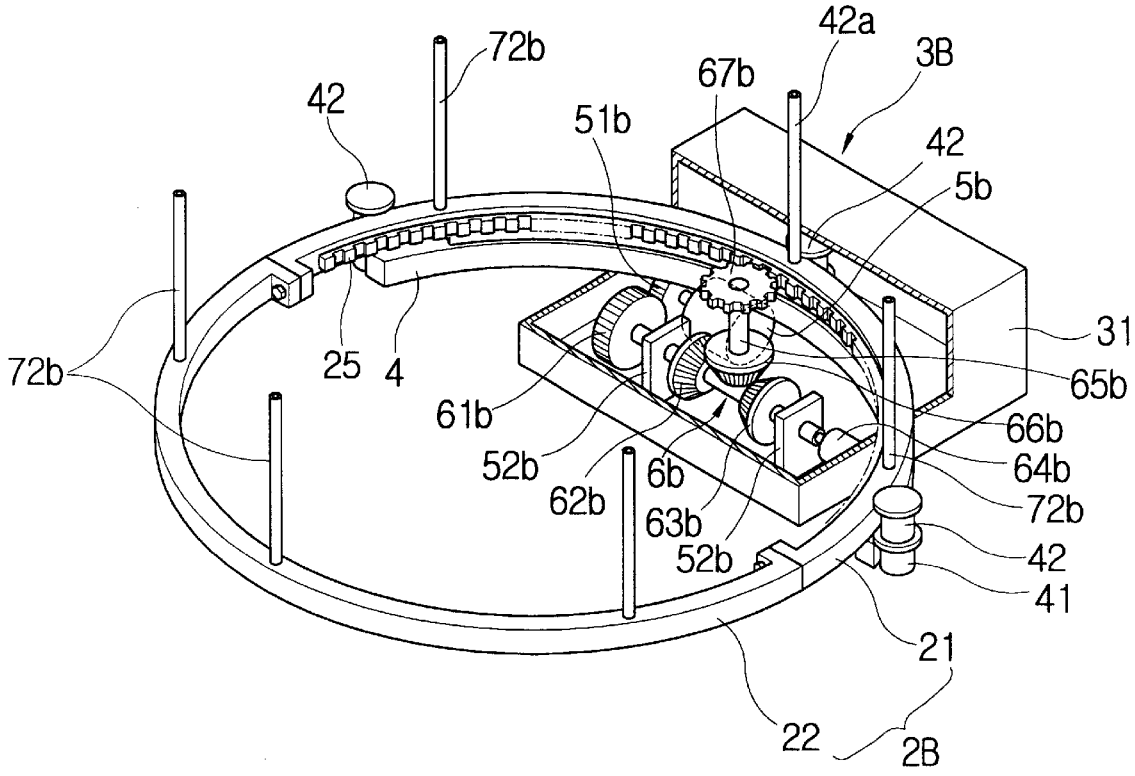
FIG. 9 is a perspective and partly cross sectional view showing a coupled state of the driving device and the rotating device applied to FIG. 8 embodiment.
Figure 10:
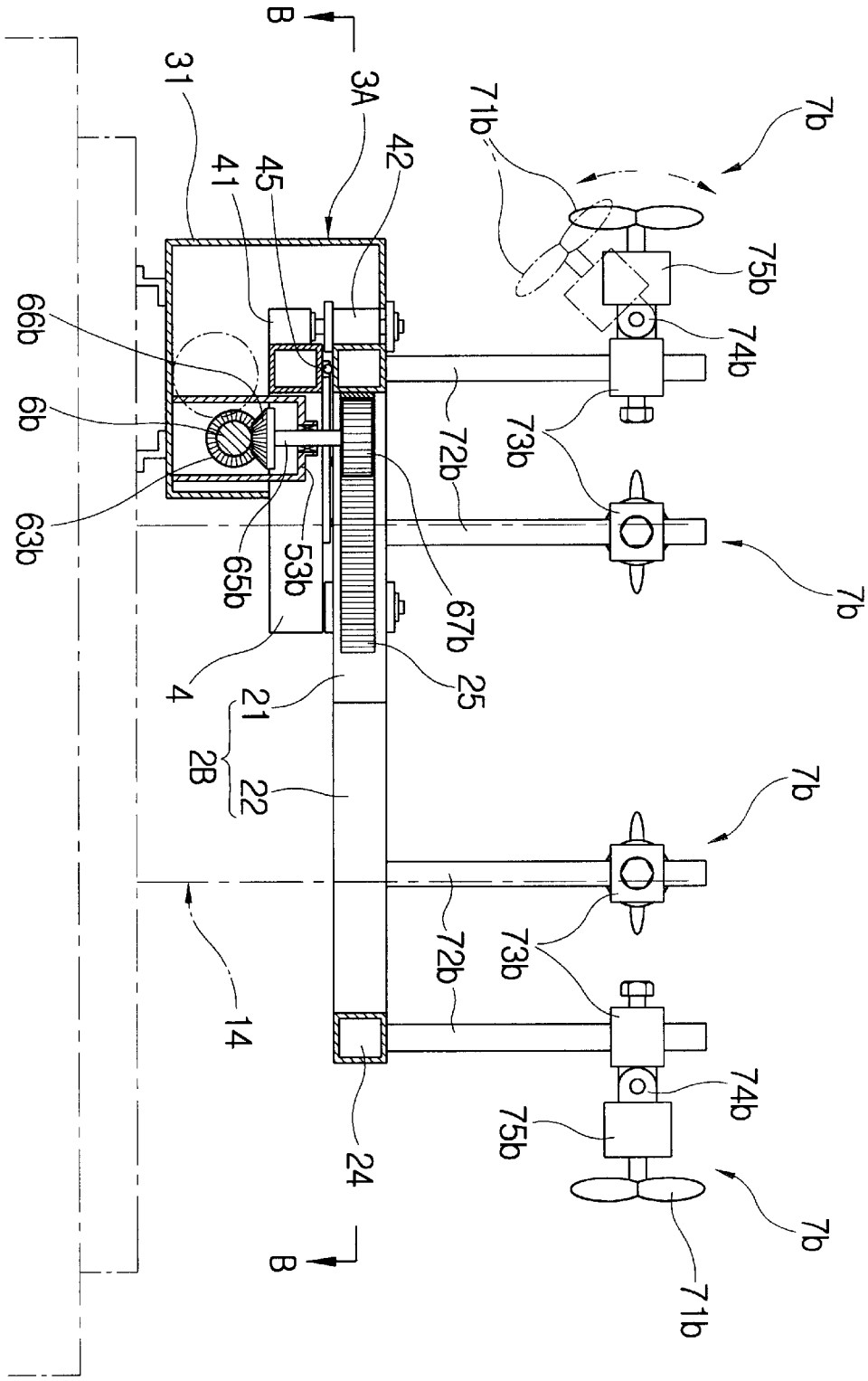
FIG. 10 is a magnified cross sectional view showing a provided state of the driving device and the rotating device applied to FIG. 8 embodiment.
Figure 11:
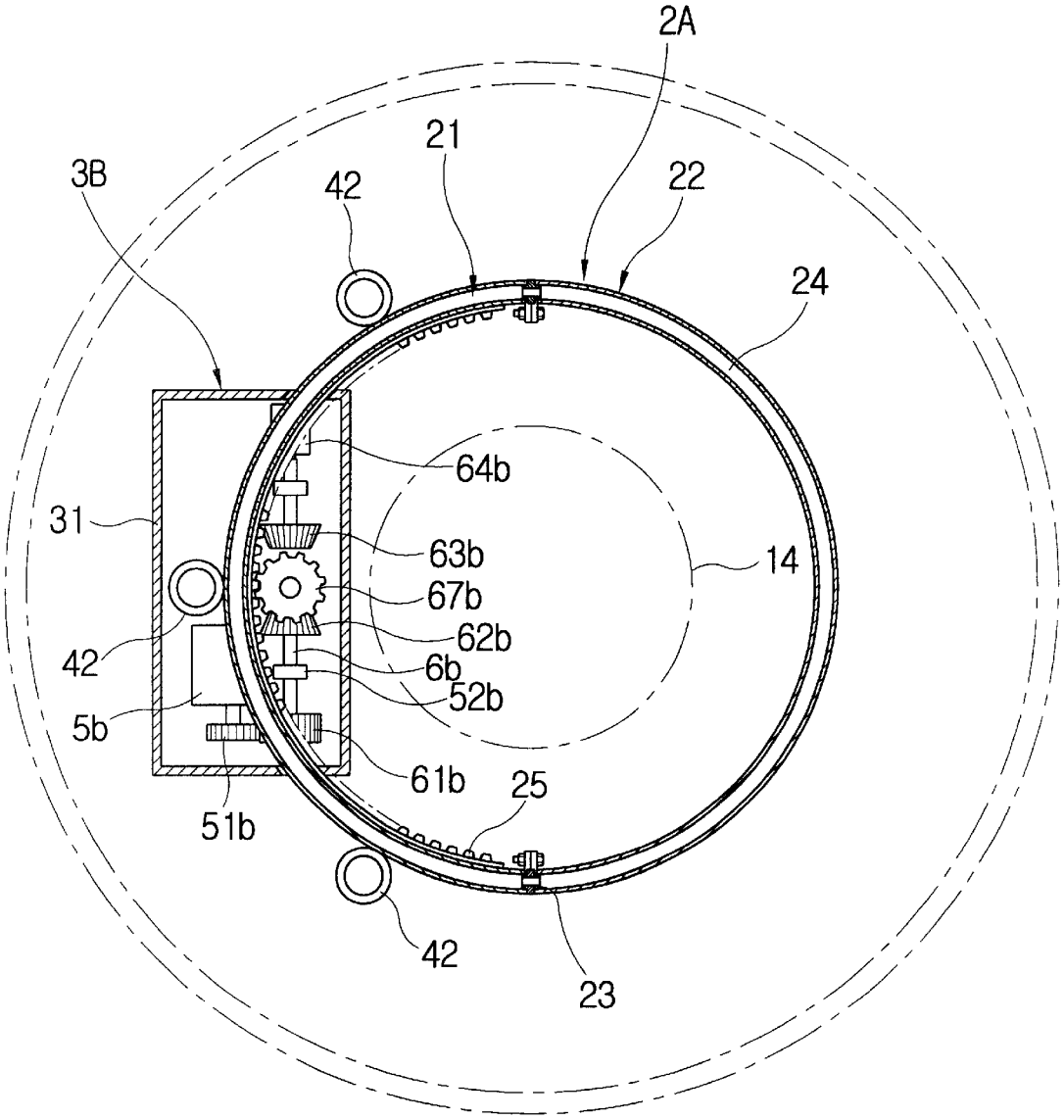
FIG. 11 is a cross sectional view taken along B—B line of FIG. 10, FIG. 12 and FIG. 13 are cross sectional views showing an operating state of the driving device applied to FIG. 8 embodiment.
Figure 13:
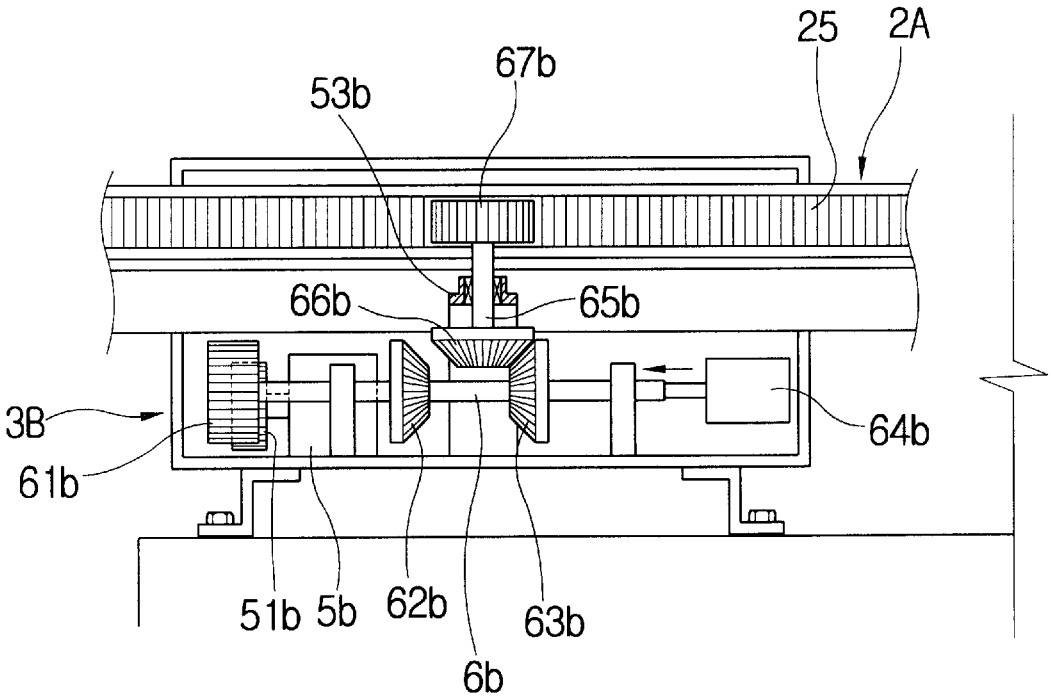
Figure 14:
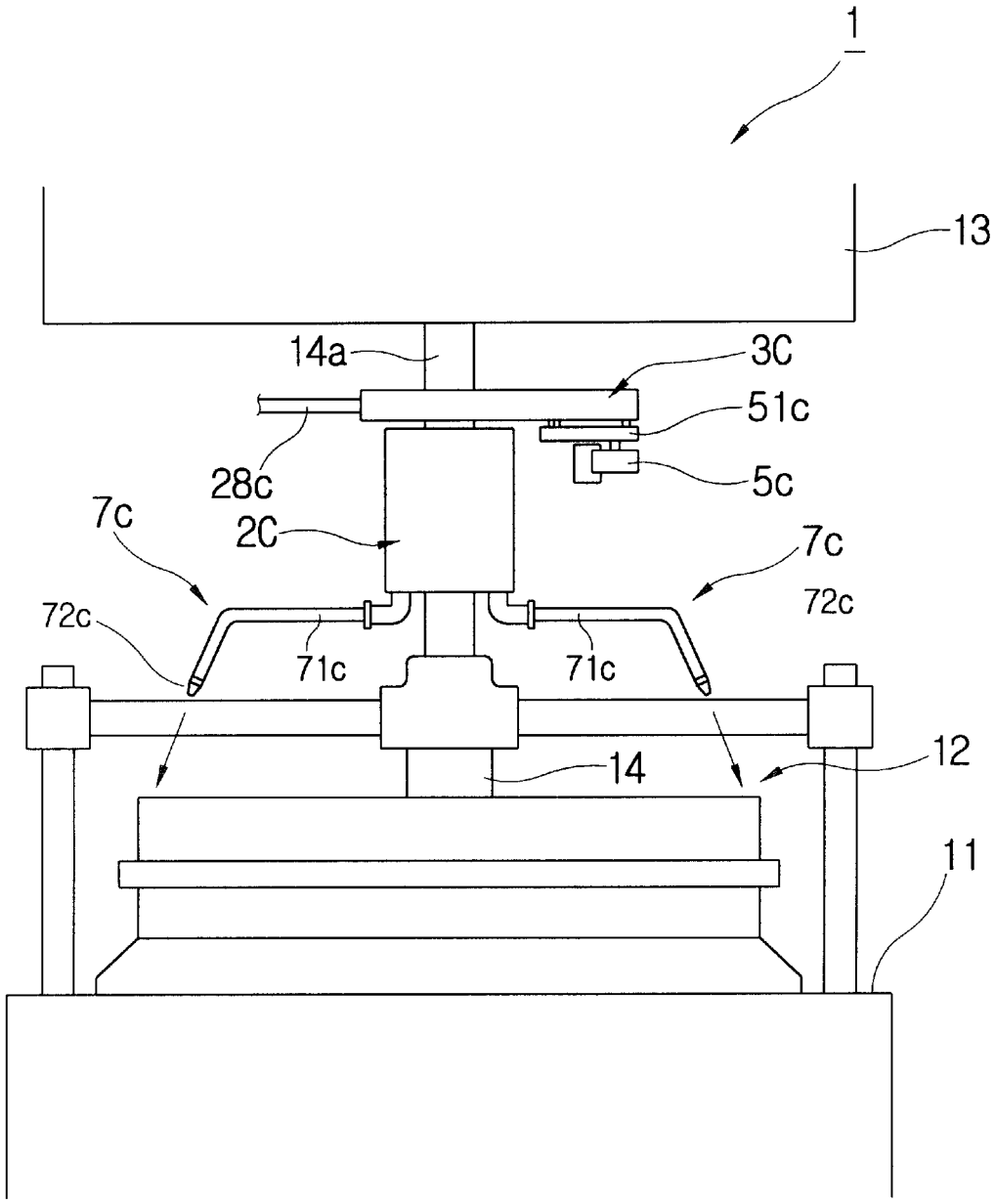
FIG. 14 is still other embodiment of the present invention, which is a schematic view showing a provided state of the driving device and the rotating device provided to small diameter center shaft of the circular knitting machine.
Figure 15:
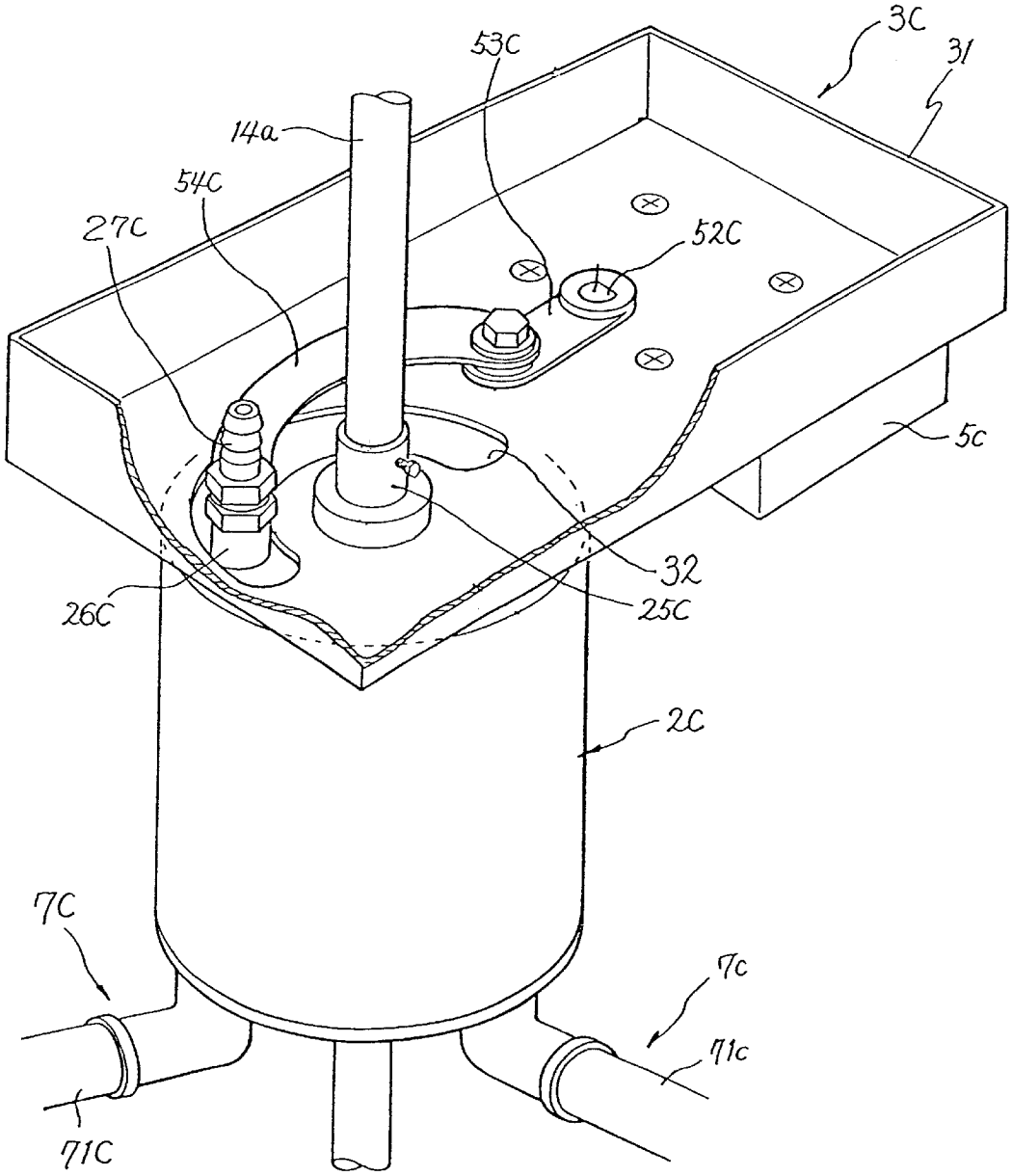
FIG. 15 is a partly cut out perspective view of the driving device and the rotating device of FIG. 14 embodiment.
Figure 16:
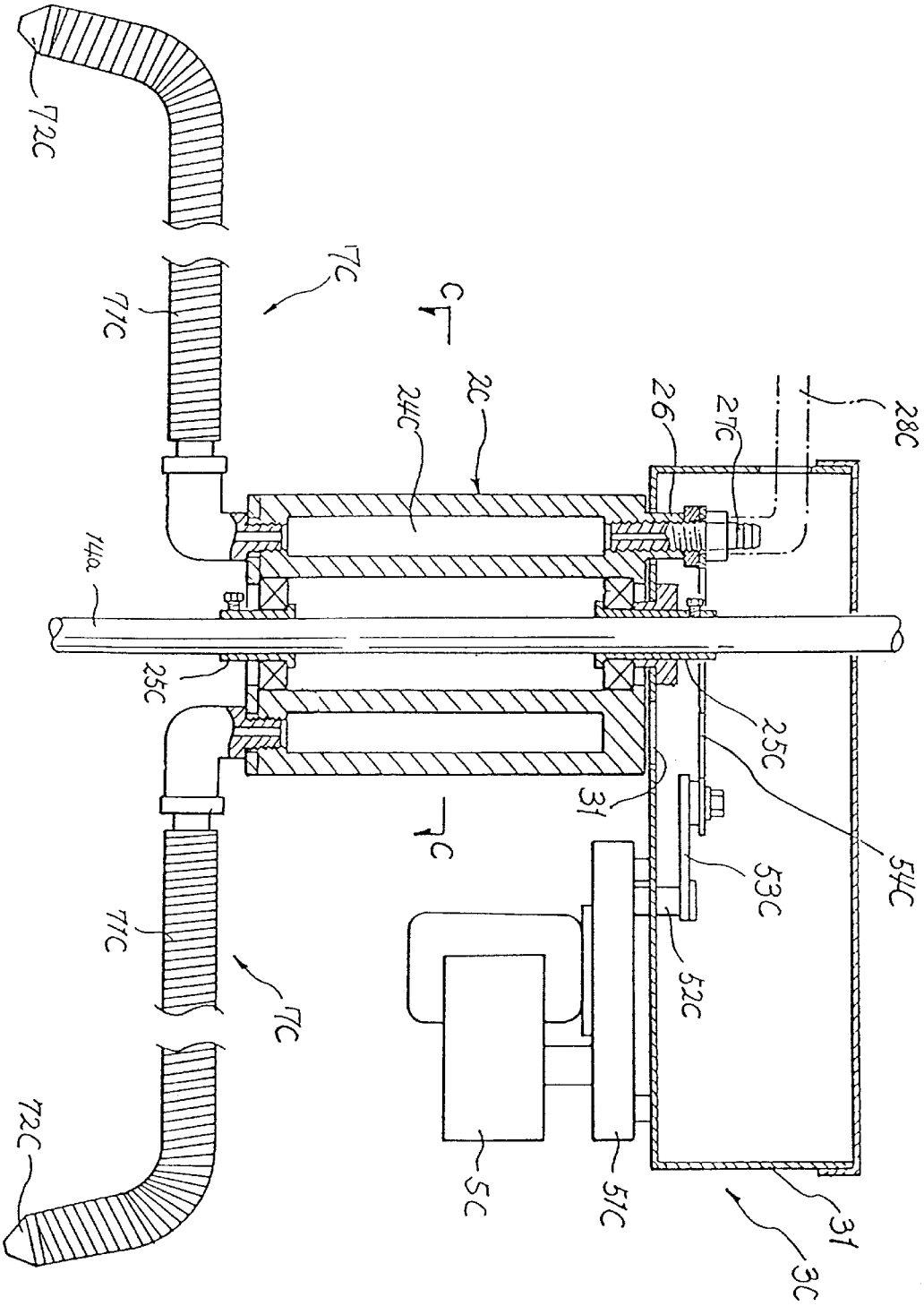
FIG. 16 is a cross sectional view showing a provided state of the driving device and the rotating device of FIG. 14 embodiment.

Next, FIG. 9 and FIG. 13 make a plurality of air blowing device 7*b* which are the air blowing means provided on a rotating device 2B of rotating means surrounding big diameter center shaft 14 of the circular knitting machine 1 to be an air blowing fan 71*b* structure, and on the other hand, a driving device 3B of the driving means shows an embodiment for reciprocately rotating a rotating device 2B to regular/reverse directions by utilizing a motor 5*b* driving to one direction.

The rotating device 2B on aforesaid embodiment is a structure in which rack gear 25 attached in arc shape is provided to outer circumferential surface of one side arc shaped ring 21, and it is a structure that a middle portion of the arc shaped ring 21 attached with the rack gear 25 is provided at a state passing horizontally through case 31 interior of the driving device 3B, and a structure for repeatedly shifting a power of the motor driving to one direction to regular/reverse directions is mounted to interior of the driving device 3B, and a plurality of air blowing device 7*b* provided on the rotating device 2B are structured by the air blowing fan 71*b*.

It will be described for the driving device 3B which is a driving means of an embodiment made of structure as above.

The driving device 3B in aforesaid embodiment is also made to a structure in which a case 31 is fixedly provided to one side around center shaft 14, i. e., to one side of the upper plate (needle disk) 124 of the circular knitting machine 1.

A motor 5*b* for driving to one direction is mounted within the driving device 3B, and an output gear 51*b* is mounted to output side of the motor 5*b*.

A rotating shaft 6*b* is provided, to be possible with rotating operation and simultaneously a sliding operation to axial direction as well, to a pair of supporter 52*b* provided to be confronted each other at bottom of the case 31.

A driving gear 61*b* engaged with the output gear 51*b* is pivotally mounted to one end of the rotating shaft 6*b* so that a rotational power can be received from the motor 5*b*, and bevel gears 62*b*, 63*b* for regular/reverse rotations are pivotally mounted between a middle portion of the rotating shaft, i. e., a pair of supporter 52*b* supporting the rotating shaft 6*b* so as to be confronted each other as they are distanced at appropriate distance.

And, another end of the rotating shaft 6*b* is connected to an actuator 64*b*, and the actuator 64*b* is made to permit a rotational operation of the rotating shaft 6*b* and simultaneously doing an operation of pushing and pulling the rotating shaft itself 6*b* as much as predetermined distance, and the actuator 64*b* is made to repeat a pushing operation and pulling operation by a not shown electric or electronic circuit at predetermined time period. For instance, in case when the rotating device 2B is made to do a reciprocating rotation to regular/reverse direction within range of 60° (preferably about 61°–65° bing got out of 60° a little) angle, during a time in which the rotating devide 2B rotates 60° to regular direction, the actuator 64*b* starts an operation for pulling the rotating shaft 6*b* and making the regular rotating bevel gear 62*b* and the a cooperative bevel gear 66*b* are made to be engaged state, on the contrary, during the rotating device 2B starts a rotational operation to 60° angle to reverse direction, the actuator pushes the rotating shaft 6*b* and the reverse rotating bevel gear 63*b* is made to be engaged to the cooperative bevel gear 66*b*.

Thus, the rotating device 2B is made to repeat an operation for pushing and pulling the rotating shaft 6*b* at time period in which the rotating device 2B rotates a set angular range to regular or reverse direction, so that the actuator 64*b* is made to make the rotating device 2B to do a reciprocating rotation to regular/reverse directions.

And, the actuator 64*b* can be constructed by cylinders operating by pneumatic pressure or oil pressure, and it can also be constructed by solenoids doing electrically reciprocating operation.

Next, a cooperative shaft 65*b* being vertically provided is supported to be possible to do a rotating operation to horizontal supporter 53*b* provided to cross upward of regular/reverse bevel gear 62*b*, 63*b* being so provided that gears confronts each other to middle portion of the rotating shaft 6*b*, and the cooperative bevel gear 66*b* mounted to bottom end of the cooperative shaft 65*b* is made, as described before, to be alternately and repeatedly engaged at predetermined time period to each of regular rotational bevel gear 62*b* and reverse rotational bevel gear 63*b* by an operation of the actuator 64*b*. For instance, in case when the actuator 64*b* pulls the rotating shaft 6*b* (rightward direction in the drawings), the regular bevel gear 62*b* of left side is engaged to the cooperative bevel gear 66*b*, on the contrary to this, in case when the actuator 64*b* pushes the rotating shaft 6*b* (leftward direction in the drawings), the reverse rotational bevel gear 63*b* of right side is engaged to the cooperative bevel gear 66*b*.

And, a driven gear 67*b* for reciprocately rotating the rotating device 2B to regular/reverse directions is mounted to upward of the cooperative shaft 65*b*, and the driven gear 67*b* does an important operation making the rotating device 2B to be reciprocately rotated to regular/reverse directions.

That is, the driven gear 67*b* is engaged to the rack gear 25 attached to inner circumferential surface of one side arc shaped ring 21 of the rotating device 2B passing through interior of the case 31 of the driving device 3B whereby executes an operation for rotating the rotating device 2B to regular/reverse directions.

And, in aforesaid embodiment also, a bottom portion of the rotating device 2B being a rotating means is supported by ball bearing 45 to the fixed guide rail 4 fixedly provided in a state passing through the interior of the case 31 of the driving device 3B so that a rotating operation is possible, and the outer circumferential surface is supported by a several guide rollers 42.

Next, an air blowing means for removing the lint by blowing a wind is provided with a plurality of air blowing device 7*b* made of air blowing fan 71*b* to the rotating device 2B of aforesaid embodiment.

A plurality of air blowing devices 7*b* being an air blowing means in this embodiment comprises: a hollow shaped vertical supporting bar 72*b* provided on the rotating device 2B at predetermined intervals, a height adjusting means 73*b* which is inserted to the vertical supporting bar 72*b* and height adjustment is possible and capable of fixing at its controled position after the height adjustment, a fan motor 75*b* easily attached with angle adjustment to up and down by hinge coupling means 74*b* to the height adjusting means, and an air blowing fan 71*b* which is provided to output shaft of the motor and thereby blows a wind.

Accordingly, when the rotating device 2B reciprocately rotates a designated angle range, the air blowing fan 71*b* provided to each of plurality of air blowing device 7*b* executes an air blowing operation and thereby removes the lint.

Next, the embodiment of FIG. 14 to FIG. 19 are embodiment suitable for the circular knitting machine provided with fixed shaft 14*a* made by separately small diameter on center shaft 14 of the circular knitting machine main body center portion, and the rotating devide 2C being a rotating means in this embodiment is supported by a bearing to the fixing means 25*c* fixed to top and bottom sides of the fixed shaft 14*a* of small diameter and provided to be free in rotation, and the rotating device 2C also constructed by double tube structure and thereby a connecting pathway 24*c* is formed to interior.

A case 31 of the driving device 3C being a driving means is fixedly provided to upper side fixing means 25*c* at upward of the rotating device 2C, and a motor 5*c* for driving to one direction and a reducing gear 51*c* for reducing an output of the motor are provided to one side bottom of the case 31 of the driving device 3C, and the output shaft 52*c* of the reducing gear 51*c* is entered to an interior of the case 31.

A cam link 54*c* is connected to end of the rotating link 53*c* at top end of the output shaft 52*c* of the reducing gear 51*c*.

On the other hand, an arc shaped reciprocating guide pathway 32 having small radius than a radius of the rotating device 2C is formed to bottom portion of the case 31 located at right upward of the rotating device 2C, and a connecting means 26*c* protruded at one side of top surface of the rotating device 2C through the reciprocating guide pathway 32 is entered to the interior of the case 31.

A free end of the cam link 54*c* connected to the rotating link 53*c* is connected to the connecting means 26*c* of the rotating device 2C by an air feeding means 27*c*, and an air hose 28*c* for guiding a compressed air from exterior is connected to the air feeding means 27*c*.

Accordingly, when the motor 5*c* of the driving device 3C is driven, the rotating link 53*c* attached to the output shaft 52*c* is rotated to one direction, on the contrary, the cam link 54*c* executes a reciprocating movement and makes the rotating device 2C to be reciprocately rotated to regular/reverse directions.

In aforesaid embodiment, the rotating angle for rotating the rotating device 2C to regular/reverse direction is desirable to make not to exceed 18°, and the width of rotating angle can be controled to a structure making a length of the rotating link 53*c* to be long or short. That is, in case when a length of the rotating link 53*c* is long, a rotating angle width of the rotating device 2C becomes longer and on the contrary to this, in case when a length of the rotating link 53*c* is short, a width of the rotating angle becomes narrower.

And, a plurality of air blowing devices 7*c* being an air blowing means are provided at predetermined intervals to bottom portion of the rotating device 2C being a rotating means of aforesaid embodiment as well, and each of the air blowing device 7*c* of the air blowing means is constructed by the air jetting pipe 71*c* made of flexible tube material such as metal made or synthetic resin made creased tube and the like as aforementioned embodiment so that the jetting nozzle 72*c* is bent to face the needle portion and thereby the lint can be effectively removed.

Figure 7:
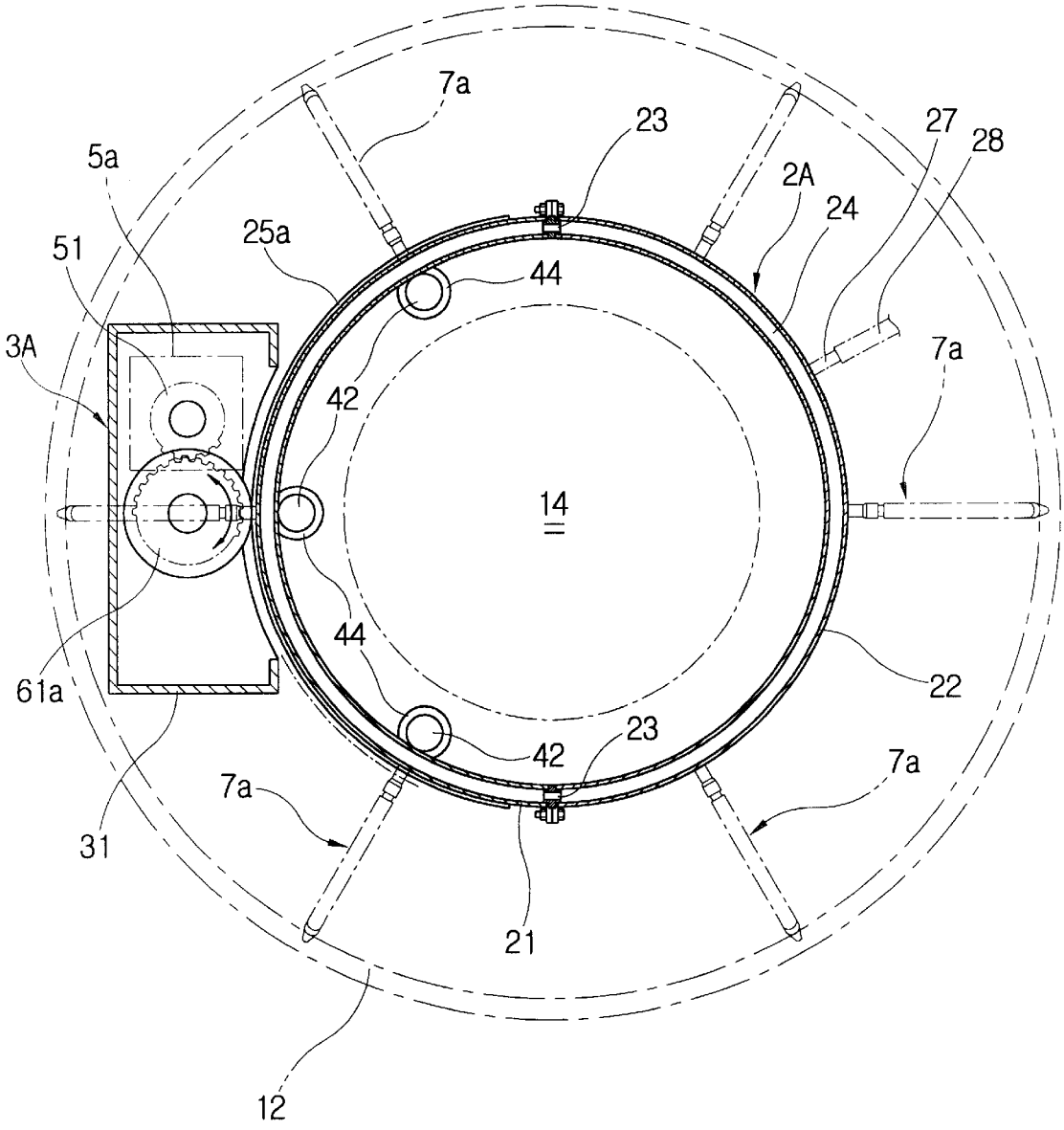
FIG. 7 is a plane cross sectional view showing a modified embodiment of the power transferring structure between the driving device and the rotating device of an embodiment of FIG. 1.
Figure 8:
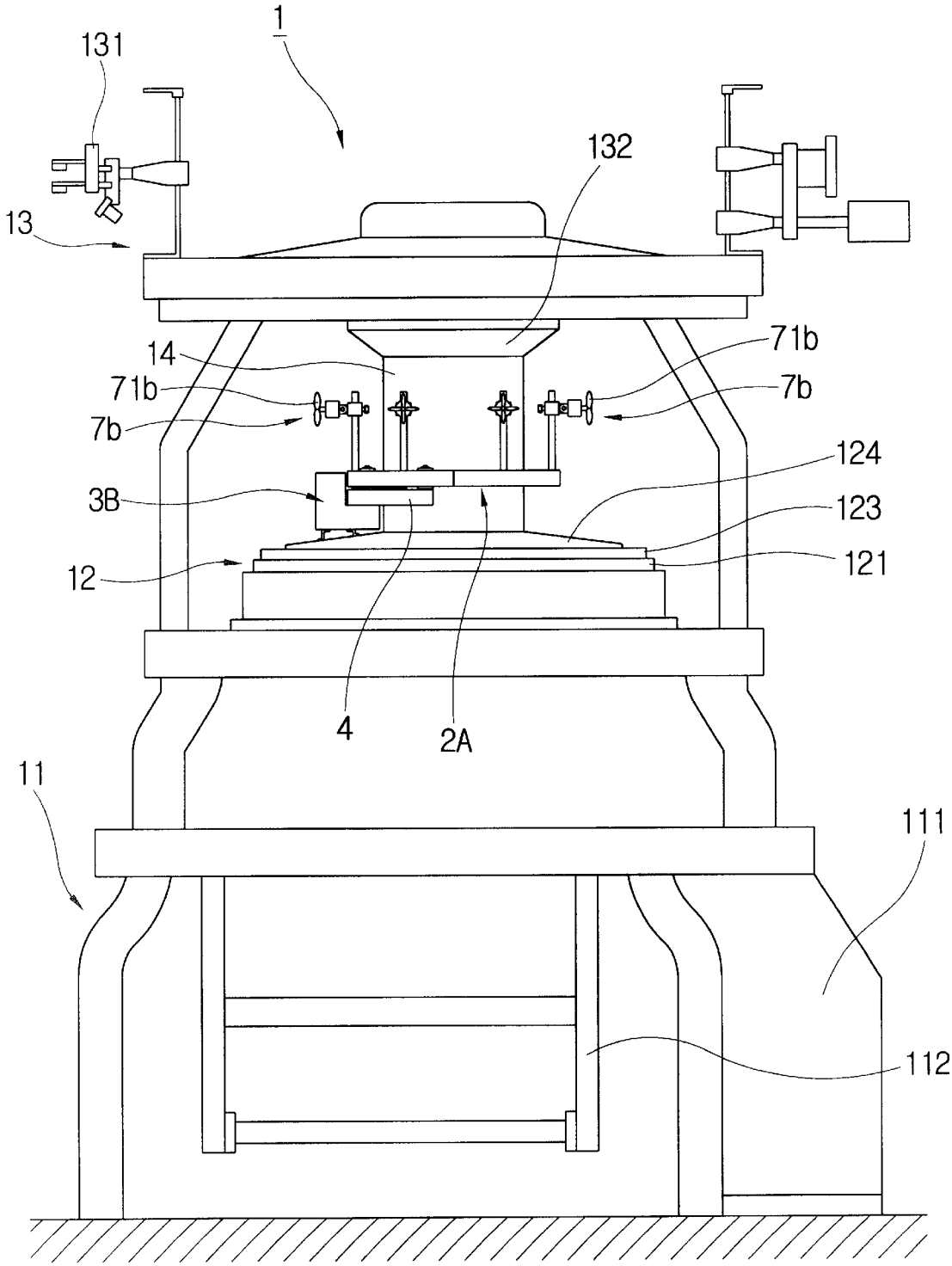
FIG. 8 is another embodiment of the present invention, which is a schematic view showing a provided state of the rotating device applied the air blowing device constructed by air blowing fan to a big diameter center shaft of the circular knitting machine.

On the other hand, the embodiment of FIG. 7 is an embodiment in which an arc shaped ring 25*c* is attached instead of rack gear 25 to outer circumferential surface of the rotating device 2A and while a driving roller 61*a* is provided instead of driving gear 6*a* of the driving device 3A, and this embodiment utilizes a frictional force of driving roller 6*a* and arc shaped ring 25*a* so that the rotating device 2A can make a reciprocating rotation.

Operation of each embodiment of the present invention made of such constructional principle will be described below.

Firstly, the embodiment from FIG. 1 to FIG. 6 is an embodiment in which a plurality of air blowing devices 7*a* being an air blowing means provided at predetermined intervals to the rotating device 2A of the rotating means are constructed to an air jet feeding pipe 71*a* for jetting the compressed air, and for a ring type rotating device 2A provided to a big diameter middle shaft 14 of the circular knitting machine 1, the driving gear 6*a* engaged to the output gear 51*a* of the regular/reverse rotational motor 5*a* mounted to the case 31 of the driving device 3A makes the rotating device 2A to execute a reciprocating rotation to regular/reverse directions within range of already set angle. According to this, a plurality of air blowing devices 7*a* connected at predetermined intervals to the rotating device 2A reciprocates respectively the set angle range, and while the compressed air fed through the air hose connected to the air injecting means 27 of one side of the rotating device 2A is flowed in to the connecting pathway 24 and spread to whole of it and discharged through the air jetting pipe 71*a*, and since it is constructed to a state that inner diameter of the air feeding means 26 neighboring to the air injecting means 27 is narrow while the inner diameter of the air feeding means 26 neighboring far away distance from the air injecting means 27 becomes gradually bigger, although it becomes a state that the air pressure of a part neighbored to the air injecting means 27 is high while the air pressure is low the more it is left far away, since the air jetting pressure discharged to the jetting nozzle 72*a* of the air jetting pipe 71*a* of each of plurality of the air blowing device 7*a* connected at predetermined intervals to the rotating device 2A becomes a state all are even, that is, it becomes to be jetted by an air pressure being sufficient to remove the lint, each of a plurality of the air jetting pipes 7*a* becomes to jet the air by a jetting pressure being sufficient to remove the lint to be piled on the needle portion 12 existing within a range in which itself does a reciprocating movement, that is, the lint to be piled to the needle provided in horizontal state to the yarn guide 125 portion and dial fixing plate(supporter) 122 and to the needle provided in vertical state to the cylinder 121, and thereby the lint piled or fallen over whole of needle portion can be effectively removed, and since a set angle of a plurality of the air jetting pipes 7*a* is set to 30°–90° in vertical on a basis of dial 123 being a horizontal surface, the lint being fallen or piled toward needle portion 12 can be effectively removed. (refer to FIG. 4)

Next, the embodiment from FIG. 8 to FIG. 13 is an embodiment so constructed that a plurality of air blowing devices 7*b* being an air blowing means provided at predetermined intervals to the rotating device 2B of the rotating means are constructed to the air blowing fan 71*a* so as to remove the lint, and when explaining firstly an operation in which the rotating device 3B surrounding the center shaft 14 of the circular knitting machine 1 reciprocately rotates to regular/reverse directions, it will be as follows.

Figure 12:
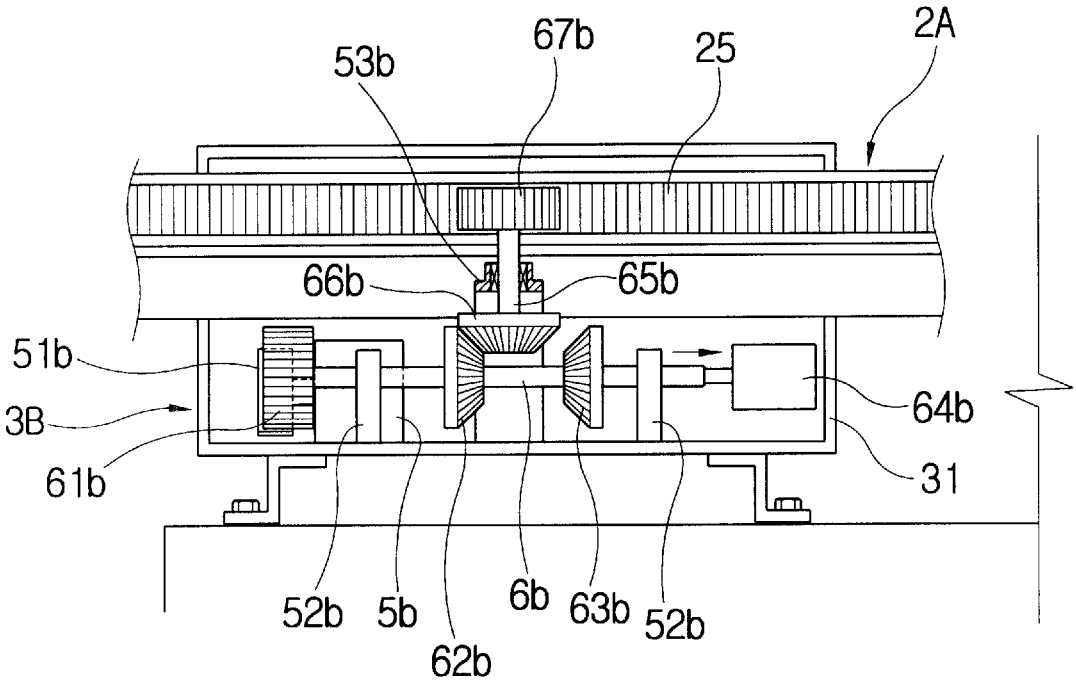

When the motor 5*b* mounted to interior of the driving device 3B of the driving means is driven, the driving gear 52*b* engaged to the output gear 51*b* becomes to rotate and the rotating shaft 6*b* also becomes to rotate simultaneously, and regular/reverse rotational bevel gears 62*b*, 63*b* provided in symmetrical each other to middle portion of the rotating shaft 6*b* also are a state of rotating to same direction, and at this moment, as shown in FIG. 12, when the rotating shaft 6*b* is pulled to right side on the drawings and regular rotational bevel gear 62*b* is engaged to the cooperative bevel gear 66*b*, the cooperative bevel gear 66*b* becomes a state of rotating to regular direction, and according to this, since the driven gear 67*b* also rotates to regular direction and it makes the rack gear 25 to rotate to regular direction, the rotating device 2B becomes to rotate to regular direction.

Thus, the actuator 64*b* engaged the regular bevel gear 62*b* to the cooperative bevel gear 66*b* maintains an operation for pulling the rotating shaft 6*b* only until the rotating device 2B regularly rotating at a designated angle, and when the rotating device 2B reaches a time point finishing the rotating operation up to a designated angle, since the actuator 64*b* pushes out the rotating shaft 6*b* to left side on the drawings as shown in FIG. 13, the regular rotating bevel gear 62*b* is disengaged at the cooperative bevel gear 66*b* while the reverse rotating bevel gear 63*b* is engaged to the cooperative bevel gear 66*b*, at this moment, since the driven gear 67*b* becomes to rotate to reverse direction, the rotating device 2B also becomes to rotate to reverse direction.

On the other hand, thus since the actuator 64*b* pushes and pulls the rotating shaft 6*b*, even the driving gear 61*b* becomes a state of moving to right and left, since a width is widely made so as to be able to continuously maintain a state in which the driving gear 61*b* is engaged to the output gear 51*b*, during the motor 5*b* is driven, not only the output gear 51*b* but also the rotating shaft 6*b* and the regular/reverse rotational bevel gears 62*b*, 63*b* maintain a state of rotating to one direction, and thus since the cooperative bevel gear 67*b* located between the regular/reverse rotational bevel gears 62*b*, 63*b* rotating to one direction is engaged alternately to the regular rotational bevel gear 62*b* or to the reverse rotational bevel gear 63*b*, it becomes to periodically repeat the rotating operation to regular direction and the rotating operation to reverse direction within designated angle range, and since the actuator 64*b* is made to repeat the pushing and pulling operation of the rotating shaft 6*b* at a time point that the rotating device 2B finishes the rotating operation to regular direction or to reverse direction within range of designated angle, during the circular knitting machine 1 is operated, the rotating device 2B repeats the reciprocating rotation to regular/reverse directions within range of designated angle.

Thus, since a plurality of air blowing devices 7*b* made by the air blowing fan 71*b* are provided to the rotating device 2B reciprocately rotating within range of designated angle, as the rotating device 2B repeats the reciprocating movement, aforesaid respective air blowing devices 7*b* blow a strong wind toward the needle portion 12 whereby remove the lint.

Since the air blowing fan 71*b* of the air blowing device 7*b* can be controled in moving toward up and down by the height adjusting means 73*b* inserted to the vertical supporting bar 72*b* provided at predetermined intervals on the rotating device 2B, a providing position of the air blowing fan 71*b* can be fixed to a height being most suitable to remove the lint from the needle portion 12, and when a tightening bolt of the hinge coupling means 74*b* assembled to the height adjusting means 73*b* to be able to make angle adjustment is slightly loosened and then the fan motor 75 executes angle adjustment toward up and down, the air blowing fan 71*b* is also adjusted with angle together whereby a set angle of the air blowing fan 71*b* is adjusted to a most suitable angle to remove the lint from the needle portion 12 and then the fan motor 75*b* and the air blowing fan 71*b* can be fixed to an adjusted set angle by means of tightening the tightening bolt of the hinge coupling means 74*c*.

Since the rotating device 2*b* of the embodiment as above is constructed to do a reciprocating rotation of a little wider angle width than the set intervals of a plurality of the air blowing devices 7*b* set at least predetermined distance, for instance, an angle width being got little out of set intervals between air blowing fan and air blowing fans set at equal intervals each other, a plurality of the air blowing devices 7*b* constructed by air blowing fan 71*b* becomes to blow the wind evenly over whole of the needle portion 12 whereby the lint on the needle portion can be effectively removed.

Next, as the embodiment from FIG. 14 to FIG. 19, in case when the air blowing means set to small diameter fixing shaft 14*a* of the circular knitting machine 1 is constructed to a cylindrical rotating device 2C, since the rotating link 53*c* set to the output shaft 52*c* of the motor 5*c* provided to the driving device 3C of the driving means does a circular movement, the cam link 54*c* does reciprocating movement to right and left and simultaneously it renders the pneumatic pressure distributing rotating body 2C to do a reciprocating movement within range of predetermined angle.

Figure 17:
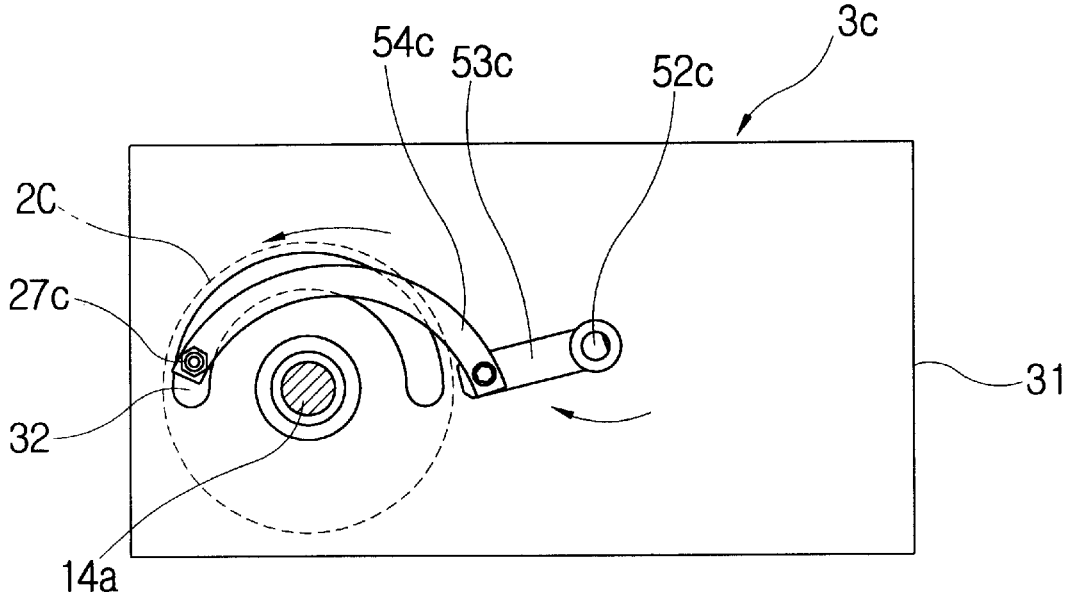
FIG. 17 and FIG. 18 are an operating state view of the driving device which reciprocately moves the rotating device of FIG. 14 embodiment to regular/reverse directions.
Figure 18:
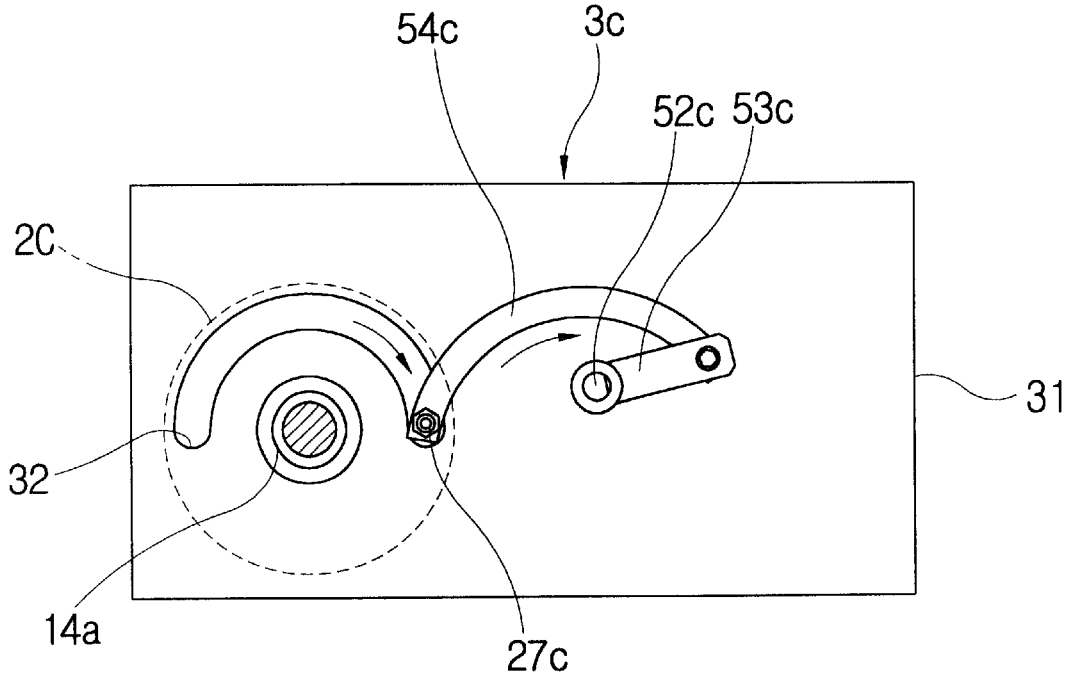
Figure 19:
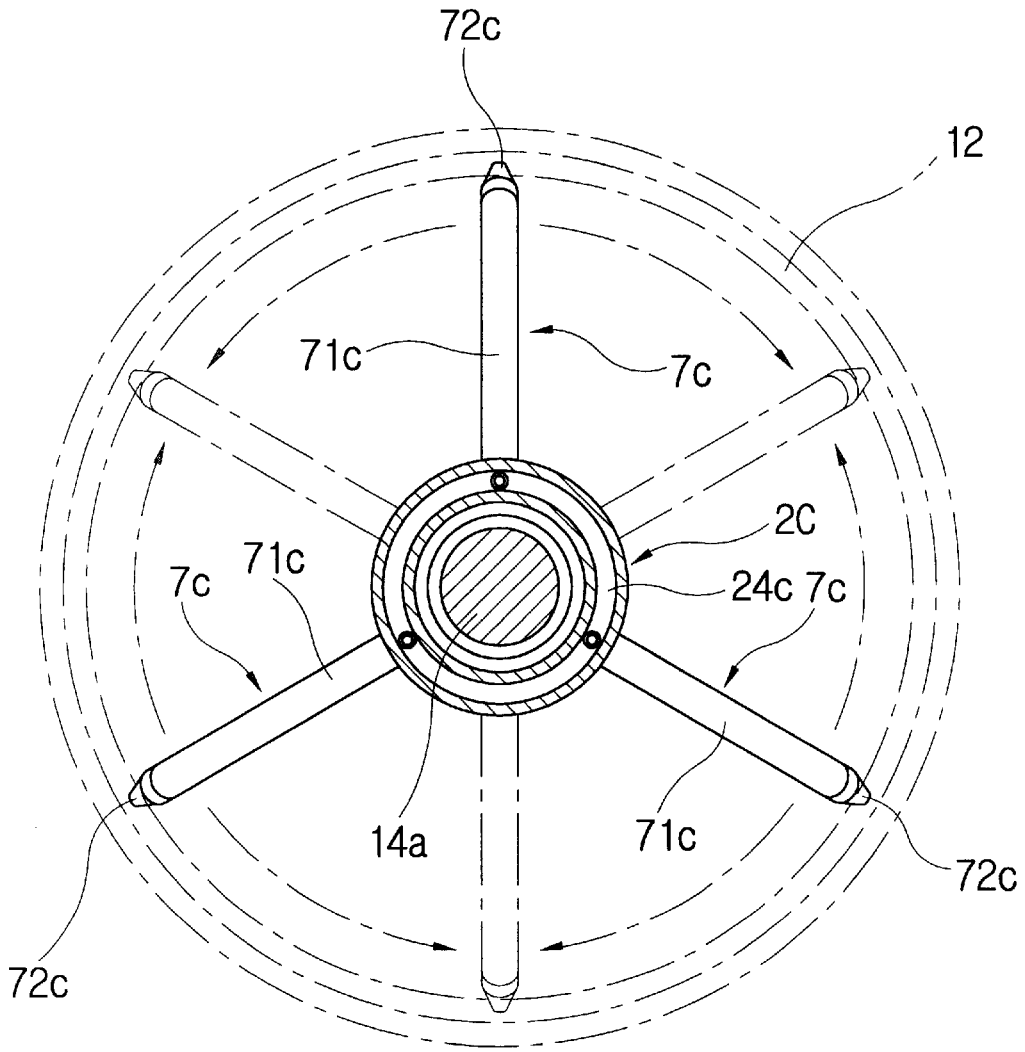
FIG. 19 is a cross sectional view taken along C—C line of FIG. 16, which is an operating state view of a plurality of air jetting tubes and the rotating device.
Figure 20:
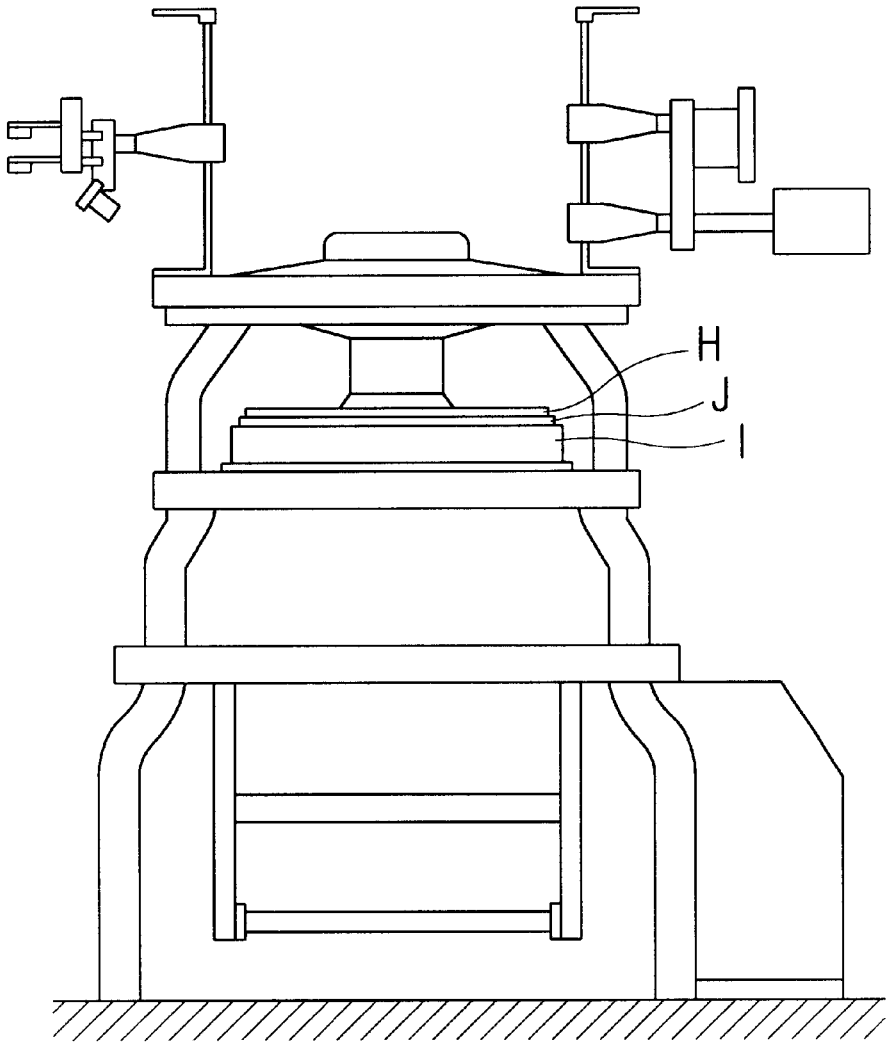
FIG. 20 is a front view of the circular knitting machine of conventional technique.
Figure 21:
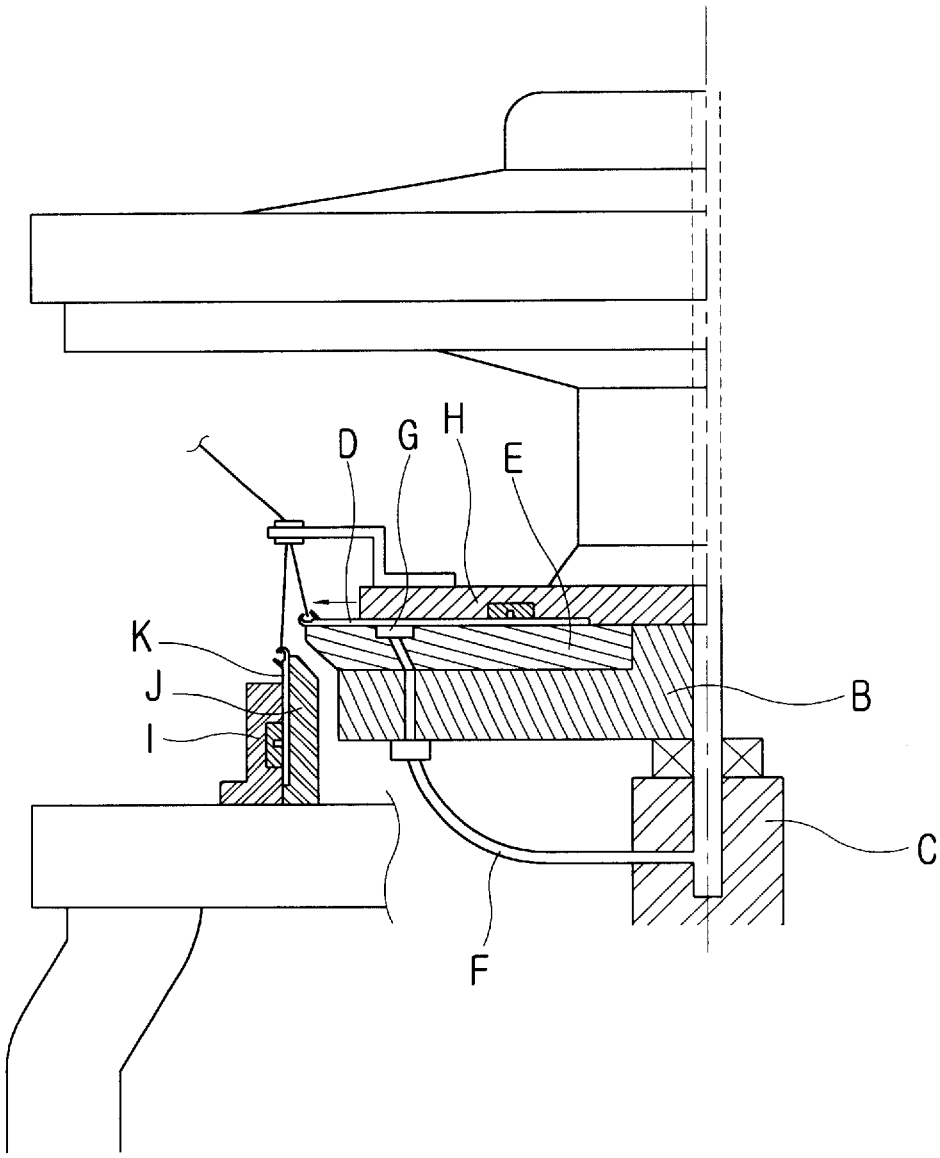
FIG. 21 is a magnified cross sectional view showing a construction of needle blower of conventional technique.
Figure 22:
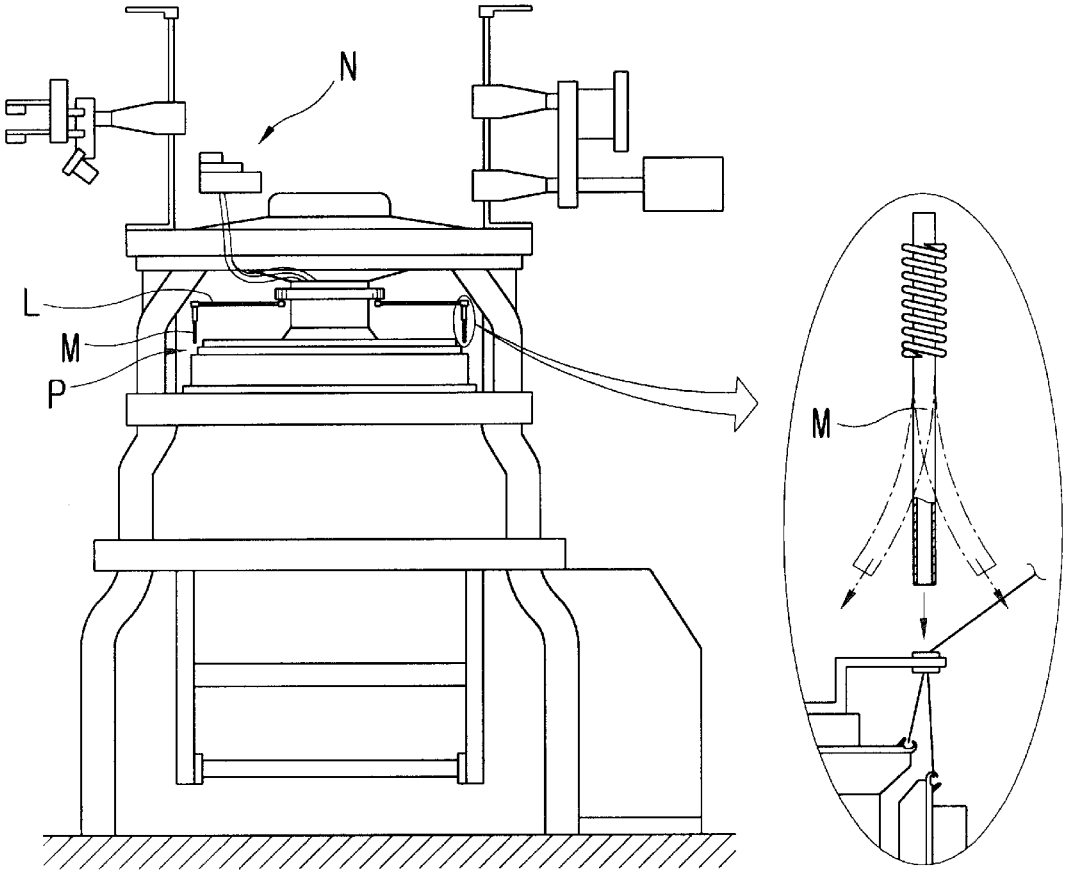
FIG. 22 and FIG. 23 are front view and partly cross sectional view of the circular knitting machine of another conventional technique.
Figure 23:
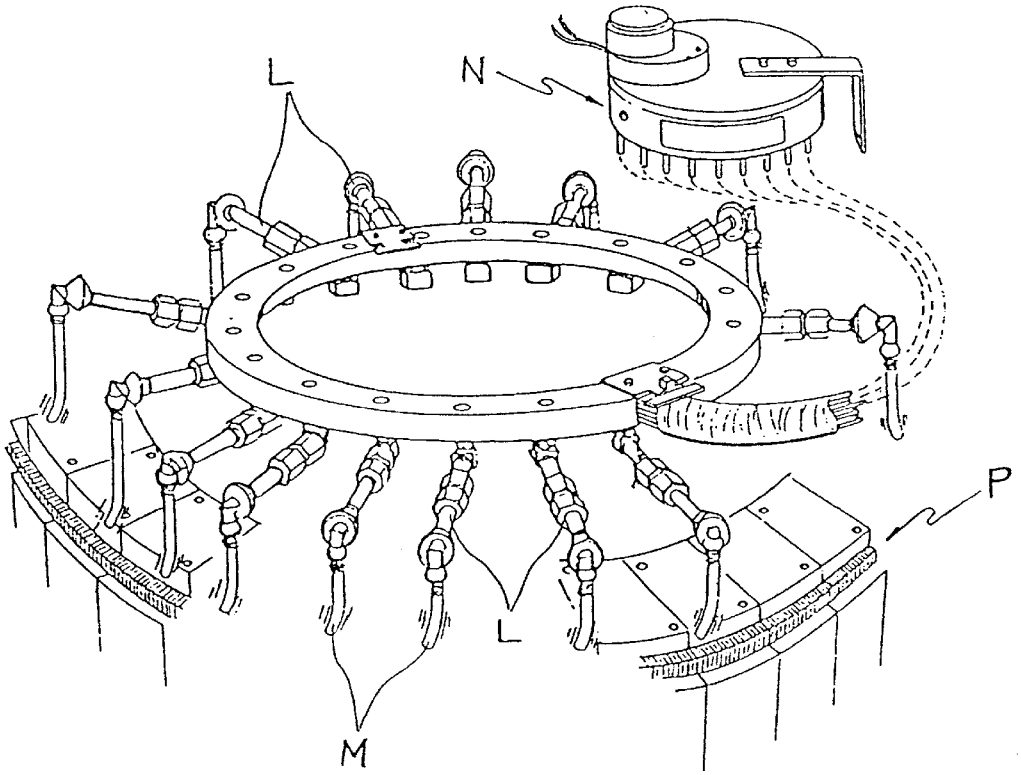

That is, as FIG. 17, in case when it is a state that the rotating link 53*c* is positioned at lower side on the drawings on a basis of center line connecting the output shaft 52*c* and the fixed shaft 14*a* and thereby if rotates to clockwise, the cam link 54*c* becomes a state moving to left side on the drawing, and at this moment, it becomes a state that the connecting means 26*c* rotates to counterclockwise along the reciprocating guide pathway 32, and as FIG. 18, in case when it is a state that the rotating link 53*c* is positioned at upper side on the drawing on a basis of center line connecting the output shaft 52*c* and the fixed shaft 14*a* and thereby it rotates to clockwise, it is a state that the cam link 54*c* moves to right side on the drawing, and at this moment, it becomes a state that the connecting means 26*c* rotates to clockwise along the reciprocating guide pathway 32. Thus, since the rotating link 53*c* executes a circular movement, the cam link 54*c* executes a reciprocating movement on a straight line and simultaneously making the rotating device 2C to do a reciprocating movement to right and left, and according to this, each air jetting pipes 71*c* constructing a plurality of air blowing devices 7*c* connected at predetermined intervals to bottom portion of the rotating device 2C executes a reciprocating movement within range of designated angle and simultaneously jetting a compressed air, and in case of this embodiment, since the rotating device 2C being a rotating means is constructed to a cylindrical shape, and since an air pressure injected through the one side's air injecting means 27*c* becomes a state evenly distributed to whole of connecting pathway 24c, and since the compressed air jetted to a plurality of air jetting pipes 71*c* is jetted by a jetting pressure being sufficient to removing the lint, the lint accumulated over whole of the needle portion can evenly be removed. And, in the case of above embodiment as well, a setting angle of a plurality of air jetting pipes is set within range of 30°–90° angle to vertical direction against the dial 123 whereby the lint piled or fallen over whole of the needle portion 12 can be effectively removed.

In accordance with the present invention as above, in rotatably providing the rotating device being a rotating means provided to surround around the center shaft of big or small diameter set at center portion of the circular knitting machine by a driving device of driving means, by means of making that the driving device does not rotate the rotating device itself to one direction but making to do a reciprocating movement to regular/reverse directions, an effect can be expected in which an air hose for feeding a compressed air to the rotating device or electric wires for supplying an electricity are not twisted to center shaft and the like, and it brings an effect that a reciprocating movement range of a plurality of air blowing devices being an air blowing means provided to the rotating device jets or blows the air by doubling each other among neighboring ones so as to remove the lint so that the lint piled over whole of needle portion, that is, the needle set to the cylinder, the needle set to the dial and the yarn guide can be removed, and since the rotating device itself is constructed in assembling type, it provides an advantage of not only upon manufacturing the circular knitting machine but also capable of easily assembling even to the circular knitting machine during already using.

What is claimed is:

1. An apparatus for removing lints in a regular/reverse type circular knitting machine comprising:

a rotating device surrounding around a center shaft of a big diameter and a small diameter of said circular knitting machine and positioned interior of a yarn group and rotatably provided by regular/reverse directions, a plurality of air blowing devices which is provided at predetermined intervals to said rotating device and blowing a strong wind toward a needle portion of the circular knitting machine, a driving device which is fixedly provided at one side around said center shaft of said circular knitting machine, and which continuously and repeatedly reciprocately moves said rotating device in the regular/reverse directions within a range of predetermined angle smaller than 360° angle, and wherein said driving device is constructed to remove the lints on said needle portion by a strong wind generated at said respective air blowing device during knitting operation of the circular knitting machine.

2. The apparatus for removing lints in regular/reverse rotational circular knitting machine as defined in claim 1, wherein said rotating device is constructed by a hollow tube body and a cylindrical tube body of double tube structure which is rotatably provided in a state surrounding said center shaft of the big diameter and the small diameter of the circular knitting machine, and a connecting pathway is formed so as to be able to feed and to wire a compressed air or electric wire supplied from exterior to the air blowing device.

3. The apparatus for removing lints in regular/reverse rotational circular knitting machine as defined in claim 1, wherein said rotating device is assembled so that an arc shaped ring of more than two having a radius capable of surrounding said center shaft of the big diameter and the small diameter of the circular knitting machine is made in circular shape.

4. The apparatus for removing lints in regular/reverse rotational circular knitting machine as defined in claim 1, wherein a plurality of respective air blowing devices provided at predetermined intervals to said rotating device are connected to be communicated with the connecting pathway of said rotating device, and which is constructed by air jetting pipes formed by flexible tube body being easy to bend so as to be able to jet towards the needle portion, the compressed air fed to the connecting pathway through air hose connected to one side of said rotating device.

5. The apparatus for removing lints in regular/reverse rotational circular knitting machine as defined in claim 1, wherein a plurality of respective air blowing device provided to said rotating device comprises:

a vertical supporting bar which is fixedly provided at predetermined intervals to said rotating device, a height adjusting means attached to said vertical supporting bar so that a height adjustment toward up and down is possible, a fan motor which is coupled by a hinge to said height adjusting means and which is so provided that a height adjustment toward up and down is possible, and an air blowing fan rotating and blowing out a strong wind which is provided to an output side of said fan motor.

6. The apparatus for removing lints in regular/reverse rotational circular knitting machine as defined in claim 1, wherein a power source of said driving device is a regular/reverse rotational motor for driving in regular/reverse directions.

7. The apparatus for removing lints in regular/reverse rotational circular knitting machine as defined in claim 1, wherein the power source of said driving device is an one directional motor for driving in one direction.

8. The apparatus for removing lints in regular/reverse rotational circular knitting machine as defined in claim 1, wherein said driving device comprises:

a regular/reverse rotational motor being a power source mounted to an interior of a case, an output gear provided to an output shaft of said regular/reverse rotational motor, and a driving gear which is engaged to said output gear for executing a reduced rotation, which is constructed such that said driving gear repeats rotation operation in regular/reverse directions and making said rotating device to be reciprocately rotated within range of predetermined angle.

9. The apparatus for removing lints in regular/reverse rotational circular knitting machine as defined in claim 1, wherein said driving device comprises:

one directional motor being a power source mounted to a case interior, a rotating shaft which is engaged with an output gear pivotally fixed to an output shaft of said one directional motor, and a driving gear receiving a power is provided to one end, a regular/reverse rotational bevel gear in which a gear portion is symmetrically provided to be confronted to each other to a middle portion of said rotating shaft, a cooperative bevel gear which is provided to a middle portion of said regular/reverse rotational bevel gear and engaged alternately to each of said regular/reverse rotational bevel gears and repeating periodically the rotating operation to regular direction and reverse direction, an actuator which is connected to other end of said rotating shaft and which repeats an operation for pushing and pulling said rotating shaft at a predetermined period and engages alternately said cooperative bevel gear to each of said regular/reverse rotational bevel gears, and which is constructed to be engaged to a rack gear of said rotating device in a state provided on same shaft as said cooperative bevel gear and reciprocately rotates said rotating device to regular/reverse directions within range of predetermined angle.

10. The apparatus for removing lints in regular/reverse rotational circular knitting machine as defined in claim 1, wherein said driving device comprises:

one directional motor mounted together with a reducing gear to a case exterior, a rotating link in which one end is fixedly attached to an output shaft of said one direction motor, a cam link in which one end is connected to a free end of said rotating link, and which is constructed such that the free end of said cam link is a structure connecting together with an air injecting means for receiving compressed air from exterior to a connecting means of said rotating device by entering the case interior through a reciprocating guide pathway of the case, and the cam link reciprocately operates in response to rotation of the rotating link to one direction upon driving of said one directional motor so as to make said rotating device to be reciprocately rotated within range of predetermined angle.

11. The apparatus for removing lints in regular/reverse rotational circular knitting machine as defined in claim 1, wherein an actuator of said driving device is made to repeat an operation of pushing and pulling the rotating shaft to a predetermined distance at a predetermined time period by an electric/electronic circuit.

12. The apparatus for removing lints in regular/reverse rotational circular knitting machine as defined in claim 6, wherein said driving device comprises:

a regular/reverse rotational motor being a power source mounted to an interior of a case, an output gear provided to an output shaft of said regular/reverse rotational motor, and a driving gear which is engaged to said output gear for executing a reduced rotation, which is constructed such that said driving gear repeats rotating operation to regular/reverse directions and making said rotating device to be reciprocately rotated within range of predetermined angle.

13. The apparatus for removing lints in regular/reverse rotational circular knitting machine as defined in claim 7, wherein said driving device comprises:

one directional motor being a power source mounted to a case interior, a rotating shaft which is engaged with an output gear pivotally fixed to an output shaft of said one directional motor, and a driving gear receiving a power is provided to one end, a regular/reverse rotational bevel gear in which a gear portion is symmetrically provided to be confronted to each other to a middle portion of said rotating shaft, a cooperative bevel gear which is provided to a middle portion of said regular/reverse rotational bevel gear and engaged alternately to each of said regular/reverse rotational bevel gears and repeating periodically the rotating operation to regular direction and reverse direction, an actuator which is connected to other end of said rotating shaft and which repeats an operation for pushing and pulling said rotating shaft at a predetermined period and engages alternately said cooperative bevel gear to each of said regular/reverse rotational bevel gears, and which is constructed to be engaged to a rack gear of said rotating device in a state provided on same shaft as said cooperative bevel gear and reciprocately rotates said rotating device to regular/reverse directions within range of predetermined angle.

14. The apparatus for removing lints in regular reverse rotational circular knitting machine as defined in claim 7, wherein said driving device comprises:

one directional motor mounted together with a reducing gear to a case exterior, a rotating link in which one end is fixedly attached to an output shaft of said one direction motor, a cam link in which one end is connected to a free end of said rotating link, and which is constructed such that the free end of said cam link is a structure connecting together with an air injecting means for receiving compressed air from exterior to a connecting means of said rotating device by entering the case interior through a reciprocating guide pathway of the case, and the cam link reciprocately operates in response to rotation of the rotating link to one direction upon driving of said one directional motor so as to make said rotating device to be reciprocately rotated within range of predetermined angle.

15. The apparatus for removing lints in regular/reverse rotational circular knitting machine as defined in claim 9, wherein an actuator of said driving device is made to repeat an operation of pushing and pulling the rotating shaft to a predetermined distance at a predetermined time period by an electric/electronic circuit.

16. A method for removing lints in a regular/reverse type circular knitting machine comprising the steps of:

rotating a center shaft of the circular knitting machine and positioning to an interior of a yarn group which is constructed by a rotating device for repeatedly and reciprocately rotating in regular/reverse directions, blowing air towards a needle portion by an air blowing means which is provided at predetermined intervals on said rotating device, driving said center shaft by a driving means which is fixedly provided at one side around said center shaft, said driving means rotates said rotating device in a continuously and repeated manner only at a range of predetermined angle smaller than 360° angle to said regular/reverse directions, and wherein each air blowing means is provided on the rotating means reciprocately rotating in the regular/reverse directions within an angle range set by said driving means which reciprocately moves and thereby removes the lint from the needle portion.

17. The method for removing lints in a regular/reverse type circular knitting machine as defined in claim 16, wherein the step of blowing air at predetermined intervals on said rotating device further comprises the step of:

providing plurality of air jetting pipes which receives compressed air from an exterior, thereby removing the lints from the needle portion by a strong air blowing from said respective air jetting pipes.

18. The method for removing lints in a regular/reverse type circular knitting machine as defined in claim 16, wherein the step of blowing air at predetermined intervals on said rotating device further comprises the step of:

receiving an electric power from an exterior, which is constructed with a plurality of air blowing fans for blowing a strong air and thereby removing the lints on the needle portion by a strong air blowing from said respective air blowing fan.

* * * * *